US009739212B1

(12) United States Patent
Srinivasan et al.

(10) Patent No.: US 9,739,212 B1
(45) Date of Patent: Aug. 22, 2017

(54) METHOD AND APPARATUS FOR DETERMINING OPTIMUM SKIP FIRE FIRING PROFILE WITH ADJUSTMENTS FOR AMBIENT TEMPERATURE

(71) Applicant: Tula Technology, Inc., San Jose, CA (US)

(72) Inventors: Vijay Srinivasan, Farmington Hills, MI (US); Louis J. Serrano, Los Gatos, CA (US)

(73) Assignee: Tula Technology, Inc., San Jose, CA (US)

( * ) Notice: Subject to any disclaimer, the term of this patent is extended or adjusted under 35 U.S.C. 154(b) by 7 days.

(21) Appl. No.: 15/148,826

(22) Filed: May 6, 2016

(51) Int. Cl.
*F02D 13/06* (2006.01)
*F02D 17/02* (2006.01)
*F02D 35/00* (2006.01)

(52) U.S. Cl.
CPC ..... *F02D 13/06* (2013.01); *F02D 35/0007* (2013.01)

(58) Field of Classification Search
CPC .. F02D 13/06; F02D 35/0007; F02D 41/0087; F02D 17/02
USPC ..... 123/198 F, 198 DB, 198 DC, 481
See application file for complete search history.

(56) References Cited

U.S. PATENT DOCUMENTS 4,172,434 A 10/1979 Coles
4,434,767 A 3/1984 Kohama et al.
4,489,695 A 12/1984 Kohama et al.
4,509,488 A 4/1985 Forster et al.
4,541,387 A 9/1985 Morikawa
5,377,631 A 1/1995 Schechter
5,408,966 A 4/1995 Lipinski et al.
5,408,974 A 4/1995 Lipinski et al.
5,553,575 A 9/1996 Beck et al.
5,584,266 A 12/1996 Motose et al.
5,692,471 A 12/1997 Zhang
5,720,257 A 2/1998 Motose et al.
5,975,052 A 11/1999 Moyer
6,158,411 A 12/2000 Morikawa
6,244,242 B1 6/2001 Grizzle et al.
6,247,449 B1 6/2001 Persson
6,408,625 B1 6/2002 Woon et al.
6,619,258 B2 9/2003 McKay et al.
6,978,204 B2 12/2005 Surnilla et al.
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,136 B2 6/2006 Ogiso
7,086,386 B2 8/2006 Doering
(Continued)

OTHER PUBLICATIONS

International Search Report dated Jun. 17, 2015 from International Application No. PCT/US2015/019496.
(Continued)

*Primary Examiner* — Hai Huynh
(74) *Attorney, Agent, or Firm* — Beyer Law Group LLP

(57) ABSTRACT

In one aspect, a skip fire engine controller is described. The skip fire engine controller includes a skip fire module arranged to determine an operational firing fraction and associated cylinder load for delivering a desired engine output. The skip fire engine controller also includes a firing controller arranged to direct firings in a skip fire manner that delivers the selected operational firing fraction. Various methods, modules, lookup tables and arrangements related to the selection of a suitable operational firing fraction are also described.

28 Claims, 21 Drawing Sheets

(56) References Cited

U.S. PATENT DOCUMENTS

| | | | |
|---|---|---|---|
| 7,111,612 | B2 | 9/2006 | Michelini et al. |
| 7,198,029 | B1 | 4/2007 | Wong |
| 7,278,391 | B1 | 10/2007 | Wong et al. |
| 7,503,312 | B2 | 3/2009 | Surnilla et al. |
| 7,509,201 | B2 | 3/2009 | Bolander et al. |
| 7,577,511 | B1 | 8/2009 | Tripathi et al. |
| 7,651,441 | B2 | 1/2010 | Maguire et al. |
| 7,785,230 | B2 | 8/2010 | Gibson et al. |
| 7,836,866 | B2 | 11/2010 | Luken et al. |
| 7,930,087 | B2 | 4/2011 | Gibson et al. |
| 8,099,224 | B2 | 1/2012 | Tripathi et al. |
| 8,108,132 | B2 | 1/2012 | Reinke |
| 8,145,410 | B2 | 3/2012 | Berger et al. |
| 8,146,565 | B2 | 4/2012 | Leone et al. |
| 8,473,179 | B2 | 6/2013 | Whitney et al. |
| 8,606,483 | B2 | 12/2013 | Krupadanam et al. |
| 8,869,773 | B2 | 10/2014 | Tripathi et al. |
| 9,020,735 | B2 | 4/2015 | Tripathi et al. |
| 9,086,020 | B2 | 7/2015 | Tripathi et al. |
| 9,200,587 | B2 | 12/2015 | Serrano et al. |
| 9,482,202 | B2 | 11/2016 | Carlson et al. |
| 9,528,446 | B2 | 12/2016 | Pirjaberi et al. |
| 2003/0116130 | A1 | 6/2003 | Kisaka et al. |
| 2003/0213467 | A1 | 11/2003 | Rayl et al. |
| 2007/0029712 | A1 | 2/2007 | Nemoto |
| 2008/0066450 | A1 | 3/2008 | Surnilla et al. |
| 2008/0154468 | A1 | 6/2008 | Berger et al. |
| 2009/0007877 | A1 | 1/2009 | Raiford |
| 2009/0177371 | A1 | 7/2009 | Reinke |
| 2010/0012072 | A1 | 1/2010 | Leone et al. |
| 2010/0043744 | A1 | 2/2010 | Suzuki et al. |
| 2010/0050993 | A1 | 3/2010 | Zhao et al. |
| 2010/0100299 | A1 | 4/2010 | Tripathi et al. |
| 2012/0191316 | A1 | 7/2012 | Leone et al. |
| 2012/0285161 | A1 | 11/2012 | Kerns et al. |
| 2014/0041625 | A1 | 2/2014 | Pirjaberi et al. |
| 2014/0046558 | A1 | 2/2014 | Kim |
| 2014/0053802 | A1 | 2/2014 | Rayl |
| 2014/0053804 | A1 | 2/2014 | Rayl et al. |
| 2014/0053805 | A1 | 2/2014 | Brennan et al. |
| 2014/0069178 | A1 | 3/2014 | Beikmann |
| 2014/0069378 | A1 | 3/2014 | Burleigh et al. |
| 2014/0069379 | A1 | 3/2014 | Beikmann |
| 2014/0069381 | A1 | 3/2014 | Beikmann |
| 2014/0090623 | A1 | 4/2014 | Beikmann |
| 2014/0090624 | A1 | 4/2014 | Verner |
| 2014/0102411 | A1 | 4/2014 | Brennan |
| 2015/0100221 | A1 | 4/2015 | Routledge et al. |
| 2015/0260117 | A1 | 9/2015 | Shost et al. |
| 2015/0354470 | A1 | 12/2015 | Li et al. |
| 2016/0252023 | A1 | 9/2016 | Srinivasan et al. |

OTHER PUBLICATIONS

Written Opinion dated Jun. 17, 2015 from International Application No. PCT/US2015/019496.

Shost et al., U.S. Appl. No. 14/638,908, filed Mar. 4, 2015.

Shost et al., U.S. Appl. No. 15/171,931, filed Jun. 2, 2016.

Nagashima et al., U.S. Appl. No. 15/148,690, filed May 5, 2016.

340

350 370

360

| | Engine speed (rpm) | | | | | | | | | | | |
|---|---|---|---|---|---|---|---|---|---|---|---|---|
| ETF | 825 | 1000 | 1250 | 1500 | 1750 | 2000 | 2250 | 2500 | 2750 | 3000 | 3250 | 3350 |
| 0 | 0 | 0 | 0 | 0 | 0 | 0 | 0 | 0 | 0 | 0 | 0 | 0 |
| 0.05 | 0.140 | 0.105 | 0.091 | 0.086 | 0.084 | 0.082 | 0.079 | 0.077 | 0.076 | 0.073 | 0.071 | 0.070 |
| 0.1 | 0.280 | 0.211 | 0.181 | 0.172 | 0.168 | 0.164 | 0.159 | 0.155 | 0.152 | 0.146 | 0.143 | 0.140 |
| 0.15 | 0.420 | 0.316 | 0.272 | 0.258 | 0.251 | 0.246 | 0.238 | 0.232 | 0.227 | 0.220 | 0.214 | 0.211 |
| 0.2 | 0.560 | 0.421 | 0.362 | 0.344 | 0.335 | 0.328 | 0.318 | 0.310 | 0.303 | 0.293 | 0.286 | 0.281 |
| 0.25 | 0.700 | 0.526 | 0.453 | 0.430 | 0.419 | 0.410 | 0.397 | 0.387 | 0.379 | 0.366 | 0.357 | 0.351 |
| 0.3 | 0.840 | 0.632 | 0.543 | 0.516 | 0.503 | 0.492 | 0.477 | 0.464 | 0.455 | 0.439 | 0.429 | 0.421 |
| 0.35 | 0.980 | 0.737 | 0.634 | 0.602 | 0.586 | 0.574 | 0.556 | 0.542 | 0.530 | 0.512 | 0.500 | 0.492 |
| 0.4 | - | 0.842 | 0.725 | 0.688 | 0.670 | 0.656 | 0.636 | 0.619 | 0.606 | 0.586 | 0.571 | 0.562 |
| 0.45 | - | 0.947 | 0.815 | 0.775 | 0.754 | 0.738 | 0.715 | 0.697 | 0.682 | 0.659 | 0.643 | 0.632 |
| 0.5 | - | - | 0.906 | 0.861 | 0.838 | 0.820 | 0.795 | 0.774 | 0.758 | 0.732 | 0.714 | 0.702 |
| 0.55 | - | - | 0.996 | 0.947 | 0.921 | 0.902 | 0.874 | 0.851 | 0.833 | 0.805 | 0.786 | 0.772 |
| 0.6 | - | - | - | - | - | 0.984 | 0.954 | 0.929 | 0.909 | 0.878 | 0.857 | 0.843 |
| 0.65 | - | - | - | - | - | - | - | - | 0.985 | 0.952 | 0.929 | 0.913 |
| 0.7 | - | - | - | - | - | - | - | - | - | - | 1.000 | 0.983 |
| 0.75 | - | - | - | - | - | - | - | - | - | - | - | - |
| 0.8 | - | - | - | - | - | - | - | - | - | - | - | - |
| 0.85 | - | - | - | - | - | - | - | - | - | - | - | - |
| 0.9 | - | - | - | - | - | - | - | - | - | - | - | - |
| 0.95 | - | - | - | - | - | - | - | - | - | - | - | - |
| 1 | - | - | - | - | - | - | - | - | - | - | - | - |

*FIG. 3*

300

370 374 372 373

| | | Engine speed (rpm) | | | | | | | | | | | |
|---|---|---|---|---|---|---|---|---|---|---|---|---|---|
| Firing fraction | Firing frequency | 825 | 850 | 875 | 900 | 925 | 950 | 975 | 1000 | 1025 | ... | 3475 | 3500 |
| 1/9 | 0.111 | 0 | 0 | 0 | 0 | 0 | 0 | 0 | 0 | 0.03 | .... | 0.24 | 0.25 |
| 1/8 | 0.125 | 0 | 0 | 0 | 0 | 0 | 0 | 0 | 0.07 | 0.15 | .... | 0.32 | 0.32 |
| 1/7 | 0.143 | 0 | 0 | 0 | 0.31 | 0.29 | 0.27 | 0.26 | 0.25 | 0.33 | .... | 0.17 | 0.17 |
| 1/6 | 0.167 | 0.25 | 0.26 | 0.27 | 0.28 | 0.29 | 0.3 | 0.305 | 0.31 | 0.315 | .... | 0.43 | 0.44 |
| 1/5 | 0.200 | 0.14 | 0.16 | 0.17 | 0.16 | 0.14 | 0.12 | 0.08 | 0.06 | 0.04 | .... | 0.29 | 0.29 |
| 2/9 | 0.222 | 0 | 0 | 0 | 0 | 0 | 0 | 0 | 0.03 | 0.07 | .... | 0.26 | 0.27 |
| 1/4 | 0.250 | 0.25 | 0.26 | 0.28 | 0.32 | 0.37 | 0.42 | 0.47 | 0.51 | 0.55 | .... | 0.79 | 0.8 |
| 2/7 | 0.286 | 0.23 | 0.26 | 0.28 | 0.31 | 0.29 | 0.27 | 0.26 | 0.25 | 0.23 | .... | 0.18 | 0.18 |
| 1/3 | 0.333 | 0.48 | 0.5 | 0.52 | 0.54 | 0.56 | 0.58 | 0.59 | 0.6 | 0.61 | .... | 0.6 | 0.71 |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| 2/3 | 0.667 | 0.64 | 0.67 | 0.69 | 0.72 | 0.75 | 0.77 | 0.79 | 0.80 | 0.81 | .... | 0.32 | 0.33 |
| 5/7 | 0.714 | 0.31 | 0.35 | 0.37 | 0.41 | 0.39 | 0.36 | 0.35 | 0.33 | 0.31 | .... | 0.43 | 0.43 |
| 3/4 | 0.750 | 0.33 | 0.35 | 0.37 | 0.43 | 0.49 | 0.56 | 0.63 | 0.68 | 0.73 | .... | 0.23 | 0.23 |
| 7/9 | 0.778 | 0 | 0 | 0 | 0 | 0 | 0 | 0 | 0.04 | 0.09 | .... | 0.57 | 0.59 |
| 4/5 | 0.800 | 0.19 | 0.21 | 0.23 | 0.21 | 0.19 | 0.16 | 0.11 | 0.08 | 0.05 | .... | 0.39 | 0.39 |
| 5/6 | 0.833 | 0.33 | 0.35 | 0.36 | 0.37 | 0.39 | 0.40 | 0.41 | 0.41 | 0.42 | .... | 0.35 | 0.36 |
| 6/7 | 0.857 | 0 | 0 | 0 | 0.41 | 0.39 | 0.36 | 0.35 | 0.33 | 0.44 | .... | 1.00 | 1.00 |
| 7/8 | 0.875 | 0 | 0 | 0 | 0 | 0 | 0 | 0 | 0.09 | 0.20 | .... | 0.24 | 0.24 |
| 8/9 | 0.889 | 0 | 0 | 0 | 0 | 0 | 0 | 0 | 0 | 0.04 | .... | 0.80 | 0.95 |
| 1 | 1 | 1 | 1 | 1 | 1 | 1 | 1 | 1 | 1 | 1 | .... | 1.00 | 1.00 |

*FIG. 6*

700

740

| Firing fraction | Firing frequency | Maximum allowed CTF | Range 1 | | Range 2 | | Range 3 | |
|---|---|---|---|---|---|---|---|---|
| | | | Min. rpm | Max. rpm | Min. rpm | Max. rpm | Min. rpm | Max. rpm |
| 1/4 | 0.250 | 0.10 | 600 | 3500 | | | | |
| 1/4 | 0.250 | 0.20 | 625 | 850 | 900 | 2100 | 2200 | 3500 |
| 1/4 | 0.250 | 0.40 | 650 | 750 | 1050 | 1800 | 2300 | 3500 |
| 1/4 | 0.250 | 0.60 | 1100 | 1700 | 2300 | 3500 | | |
| 1/4 | 0.250 | 0.80 | 1200 | 1250 | 1300 | 1600 | 2400 | 3500 |
| 1/4 | 0.250 | 1.00 | 1325 | 1550 | 2450 | 3500 | | |
| 2/7 | 0.286 | 0.10 | 700 | 1100 | 1200 | 2700 | | |
| 2/7 | 0.286 | 0.20 | 750 | 1000 | 1300 | 2600 | | |
| 2/7 | 0.286 | 0.40 | 1400 | 2500 | | | | |
| 2/7 | 0.286 | 0.60 | 1500 | 1600 | 1800 | 2500 | | |
| 2/7 | 0.286 | 0.80 | 1900 | 2400 | | | | |
| 2/7 | 0.286 | 1.00 | 2000 | 2300 | | | | |
| 1/3 | 0.333 | 0.10 | 600 | 3500 | | | | |
| 1/3 | 0.333 | 0.20 | 625 | 1400 | 1600 | 2200 | 2300 | 3500 |
| 1/3 | 0.333 | 0.40 | 700 | 1300 | 1650 | 2150 | 2350 | 3500 |
| 1/3 | 0.333 | 0.60 | 1000 | 1100 | 1750 | 2050 | 2500 | 3500 |
| 1/3 | 0.333 | 0.80 | 1775 | 2025 | | | | |
| 1/3 | 0.333 | 1.00 | 1800 | 2000 | | | | |

*FIG. 7*

METHOD AND APPARATUS FOR DETERMINING OPTIMUM SKIP FIRE FIRING PROFILE WITH ADJUSTMENTS FOR AMBIENT TEMPERATURE

FIELD OF THE INVENTION

The present invention relates to methods and systems for operating an engine in a skip fire manner More specifically, different possible working chamber output levels are taken into account to help determine an optimal skip fire firing profile.

BACKGROUND

Most vehicles in operation today (and many other devices) are powered by internal combustion (IC) engines. Internal combustion engines typically have a plurality of cylinders or other working chambers where combustion occurs. Under normal driving conditions, the torque generated by an internal combustion engine needs to vary over a wide range in order to meet the operational demands of the driver. Over the years, a number of methods of controlling internal combustion engine torque have been proposed and utilized. Some such approaches contemplate varying the effective displacement of the engine. Engine control approaches that vary the effective displacement of an engine can be classified into two types of control, multiple fixed displacements and skip fire. In fixed multiple displacement control some fixed set of cylinders is deactivated under low load conditions; for example, an 8 cylinder engine that can operate on the same 4 cylinders under certain conditions. In contrast, skip fire control operates by sometimes skipping and sometimes firing any given cylinder. In general, skip fire engine control is understood to offer a number of potential advantages, including the potential of significantly improved fuel economy in many applications. Although the concept of skip fire engine control has been around for many years, and its benefits are understood, skip fire engine control has not yet achieved significant commercial success.

It is well understood that operating engines tend to be the source of significant noise and vibrations, which are often collectively referred to in the field as NVH (noise, vibration and harshness). In general, a stereotype associated with skip fire engine control is that skip fire operation of an engine will make the engine run significantly rougher, that is with increased NVH, relative to a conventionally operated engine. In many applications such as automotive applications, one of the most significant challenges presented by skip fire engine control is vibration control. Indeed, the inability to satisfactorily address NVH concerns is believed to be one of the primary obstacles that has prevented widespread adoption of skip fire types of engine control.

U.S. Pat. Nos. 7,954,474; 7,886,715; 7,849,835; 7,577,511; 8,099,224; 8,131,445 and 8,131,447 and U.S. patent application Ser. Nos. 13/004,839; 13/004,844; and others, describe a variety of engine controllers that make it practical to operate a wide variety of internal combustion engines in a skip fire operational mode. Each of these patents and patent applications is incorporated herein by reference. Although the described controllers work well, there are continuing efforts to further improve the performance of these and other skip fire engine controllers to further mitigate NVH issues in engines operating under skip fire control. The present application describes additional skip fire control features and enhancements that can improve engine performance in a variety of applications.

SUMMARY

The present invention relates to methods and arrangements for operating an engine in a skip fire manner. In one aspect, a skip fire engine controller is described. The skip fire engine controller includes a skip fire profile module and a firing controller. The skip fire profile module is arranged to determine an operational firing fraction and associated cylinder load for delivering a desired engine output. The skip fire profile module is arranged to select the operational firing fraction from a set of available firing fractions. The set of available firing fractions varies as a function of cylinder load such that more firing fractions are available at lower cylinder loads than at higher cylinder loads. The firing controller is arranged to direct firings in a skip fire manner that delivers the selected operational firing fraction.

In another aspect, a skip fire engine controller is described. The skip fire engine controller includes a lookup table, a skip fire profile module and a firing controller. The lookup table is embodied in a computer readable media and includes table entries that indicate different maximum allowable cylinder loads at different engine speeds, transmission gears, and firing fractions. The skip fire profile module is arranged to determine an operational firing fraction suitable for delivering a requested engine output. The skip fire profile module utilizes the lookup table to determine the operational firing fraction. The firing controller is arranged to direct firings in a skip fire manner that delivers the operational firing fraction.

In still another aspect, a method for selecting an operational skip fire firing profile will be described. A desired engine output is determined. Multiple candidate firing fractions are selected from an allowed list of firing fractions. The candidate cylinder load for each of the candidate firing fractions is calculated such that the combination of the candidate cylinder load and each associated candidate firing fraction substantially yields the desired engine output. Each such combination is referred to as a candidate skip fire firing profile. One of the candidate skip fire firing profiles is selected as the operational skip fire firing profile. The internal combustion engine is operated based at least in part on the selected operational skip fire firing profile.

BRIEF DESCRIPTION OF THE DRAWINGS

The invention and the advantages thereof, may best be understood by reference to the following description taken in conjunction with the accompanying drawings in which:

FIG. 3 is an exemplary look up table compiling the base firing frequency for a range of engine torque fractions and engine speeds.

FIG. 6 is an exemplary two-dimensional look up table compiling the maximum acceptable cylinder load as a function of firing fraction and engine speed.

FIG. 7 is an exemplary one-dimensional look up table compiling acceptable engine speeds as a function of skip fire firing profiles.

In the drawings, like reference numerals are sometimes used to designate like structural elements. It should also be appreciated that the depictions in the figures are diagrammatic and not to scale.

DETAILED DESCRIPTION

Figure 1:
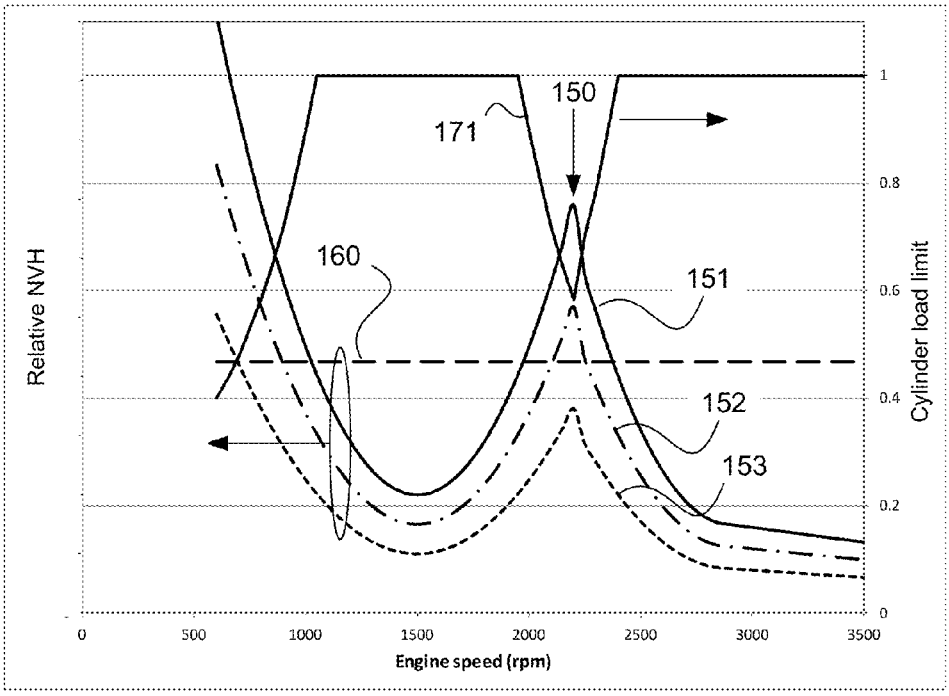
FIG. 1 is an exemplary plot of NVH versus engine speed for a selected firing frequency at various cylinder loadings and the resultant cylinder loading limit.

The present invention relates to a system for operating an internal combustion engine in a skip fire manner. More specifically, various implementations of the present invention take working chamber output into account to help determine a suitable skip fire firing frequency, firing fraction, firing pattern or firing sequence.

An internal combustion engine may be used as the power source for a motor vehicle. In vehicle applications, torque generated by the engine is transmitted to one or more of the vehicle's wheels. A power train, including a transmission having an adjustable gear ratio, is typically used to transmit the engine generated torque. Adjustment of the transmission alters the ratio between the engine rotation rate and the wheel rotation rate. During operation of a motor vehicle, a driver in the vehicle cabin typically demands a wide range of engine torque levels and engine speeds to accommodate varying driving conditions. Most vehicles in operation today operate all engine working chambers or cylinders at substantially equal load levels to accommodate these variable torque requests. That is the load on each cylinder in the engine is approximately constant, but the cylinder load goes up and down to meet the driver's torque request. For naturally aspirated spark-ignition engines, working chamber load level is adjusted primarily through use of throttling air flow into the engine. Operation in this manner is inefficient, since the working chambers are often operating far from maximum fuel efficiency conditions and throttling leads to pumping losses. Fuel efficiency can be significantly improved by operating the engine in a skip fire fashion where some working chambers are operating closer to optimum fuel efficiency and the remaining working chambers are deactivated.

In general, skip fire engine control contemplates selectively skipping the firing of certain cylinders during selected firing opportunities. Thus, for example, a particular cylinder may be fired during one firing opportunity and then may be skipped during the next firing opportunity and then selectively skipped or fired during the next. This is contrasted with conventional variable displacement engine operation in which a fixed set of the cylinders are deactivated during certain low-load operating conditions.

One challenge with skip fire engine control is reducing undesirable noise, vibration and harshness (NVH) to an acceptable level. The noise and vibration produced by the engine can be transmitted to occupants in the vehicle cabin through a variety of paths. Some of these paths, for example the drive train, can modify the amplitude of the various frequency components present in the engine noise and vibration signature. Specifically, lower transmission gear ratios tend to amplify vibrations, since the transmission is increasing the torque and the torque variation at the wheels. The noise and vibration can also excite various vehicle resonances, which can then couple into the vehicle cabin.

Some noise and vibration frequencies can be particularly annoying for vehicle occupants. In particular, low frequency, repeating patterns (e.g., frequency components in the range of 0.2 to 8 Hz) tend to generate undesirable vibrations perceived by vehicle occupants. The higher order harmonics of these patterns can cause noise in the passenger cabin. In particular, a frequency around 40 Hz may resonate within the vehicle cabin, the so called "boom" frequency. Commercially viable skip fire engine control requires operating at an acceptable NVH level while simultaneously delivering the driver desired or requested engine torque output and achieving significant fuel efficiency gains.

The NVH characteristics vary with the engine speed, firing frequency, and transmission gear. For example, consider an engine controller that selects a particular firing frequency that indicates a percentage of firings necessary to deliver a desired torque at a particular engine speed and gear. Based on the firing frequency, the engine controller generates a repeating firing pattern to operate the working chambers of the engine in a skip fire manner. As is well known by those familiar in the art, at a given engine speed an engine that runs smoothly with some firing patterns may generate undesirable acoustic or vibration effects with other firing patterns. Likewise, a given firing pattern may provide acceptable NVH at one engine speed, but the same pattern may produce unacceptable NVH at other engine speeds. Engine induced noise and vibration is also affected by the cylinder load or working chamber output. If less air and fuel is delivered to a cylinder, the firing of the cylinder will generate less output, as well as less noise and vibration. As a result, if the cylinder output is reduced, some firing frequencies and sequences that were unusable due to their poor NVH characteristics may then become usable.

This concept is depicted graphically in FIG. 1, which shows an exemplary plot of NVH versus engine speed for a selected firing frequency and various cylinder loadings for a fixed transmission gear ratio. FIG. 1 shows a set of three curves, 151, 152 and 153, corresponding to different values of cylinder loading. Curve 151 corresponds to the maximum cylinder loading, while curves 152 and 153 correspond to successively lower cylinder loading values. The cylinder loading may be defined by the cylinder torque fraction (CTF), which gives an indication of a working chamber output relative to a reference value. For example, the CTF values may be relative to the maximum possible output torque generated by a working chamber with wide open throttle at a reference ambient pressure and temperature, i.e. 100 kPa and 0 C, and the appropriate valve and sparking timing. Of course, other ranges and references values may be used. In this application CTF is generally a value between 0 and 1.0, although it may be greater than 1 in some circumstances, such as low ambient temperatures and/or operation below sea level or in boosted engines, i.e. engines with a supercharger or turbocharger. As shown in FIG. 1 lower levels of cylinder loading produce lower NVH, but the shape of the NVH curve is essentially constant for any fixed firing frequency and transmission gear ratio. In general, NVH is higher at low engine speeds because low engine speeds tend to generate vibration in the 0.2 to 8 Hz frequency range, which is particularly unpleasant to vehicle occupants. In addition, to high NVH at low engine speeds one or more resonances 150 in the NVH signature may be present at higher engine speeds. These peaks may correspond to the excitation of the cabin boom frequency or other resonances within the vehicle.

Also, shown in FIG. 1 is an acceptable NVH limit 160. This limit is shown as having a single, constant value for all engine speeds and driving conditions; however, as described below this need not be the case. In this example, the operating region below the NVH limit 160 represents a region of acceptable operating points from an NVH perspective, while regions above the NVH limit are excluded operating points. FIG. 1 also displays the cylinder load limit 171 as a function of engine speed. Curve 171 can be readily generated by comparing the NVH produced at each cylinder load and engine speed with the acceptable NVH limit. Inspection of the graph indicates that CTF values of 1, curve 151, are allowed at engine speeds above approximately 1000 rpm with the exception of the band around resonance 150 where engine speeds in the range of approximately 1950 to 2350 rpm are forbidden. For the lower CTF value of curve 152 operation is allowed at engine speeds above approximately 900 rpm with the exception of the band between approximately 2050 to 2250 rpm. For the lowest CTF shown, curve 153, operation is allowed at all engine speeds above approximately 700 rpm. Even though curve 153 displays the resonance 150, the maximum NVH at the resonant frequency is still below the allowable limit. In general, results similar to that shown in FIG. 1 may be obtained for each firing frequency and transmission gear ratio. The curves may display multiple resonances at varying engine speeds having different NVH values, but all firing frequencies and transmission gear ratios will display qualitatively similar curves. Note that in a conventionally controlled engine, i.e. without skip fire, the family of curves obtained corresponds to the case of a firing frequency equal to 1.

Figure 2:
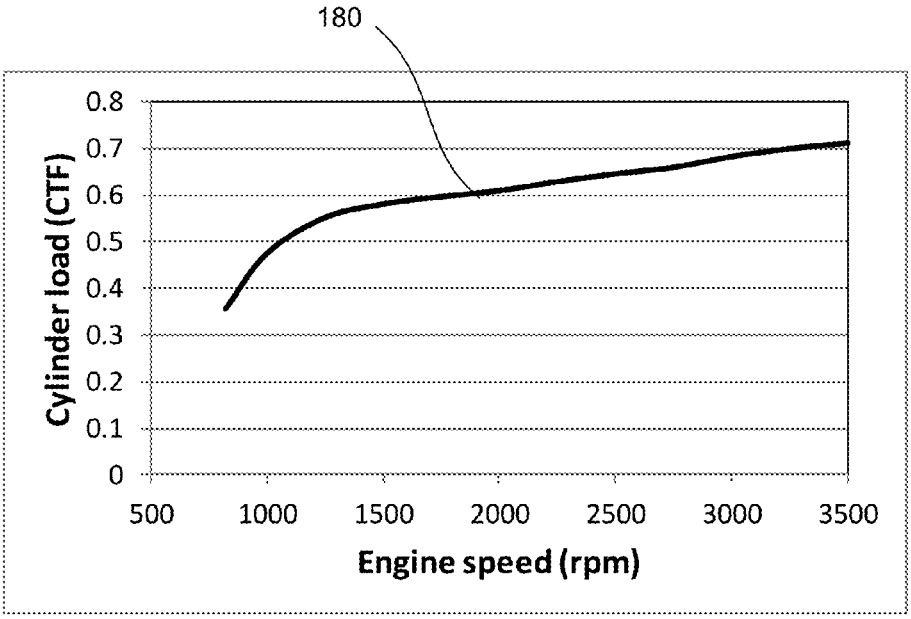
FIG. 2 is an exemplary plot of the cylinder load resulting in optimum fuel efficiency at different engine speeds.

The cylinder load can be varied by adjustment of various engine parameters, such as manifold absolute pressure (MAP), intake and exhaust valve timing, exhaust gas recirculation, and spark timing. The MAP is typically adjusted using a throttle to limit the size of the opening into the intake manifold. For engines with a cam shaft, the valve timing is adjusted using a cam phaser. Barometric pressure and ambient temperature also influence the cylinder load. For boosted engines the cylinder load may be varied by adjusting the boost level. In general, the cylinder load that provides for most efficient fuel utilization varies as a function of the engine speed. Highest fuel efficiency is typically obtained with the MAP at or near barometric pressure. The spark and cam phaser settings that yield highest fuel efficiency depend on the engine design. For each engine speed, the spark and cam phaser setting can be determined which yield the maximum fuel efficiency. The resultant optimum cylinder load that yields the highest fuel efficiency ($CTF_{opt}$) can be determined. FIG. 2 shows an exemplary graph of $CTF_{opt}$ 180 versus engine speed. In general, at low engine speed $CTF_{opt}$ is low, it increases and plateaus as the engine speed increases. At high engine speeds (not shown in FIG. 2) $CTF_{opt}$ tends to decrease. Note that $CTF_{opt}$ may vary depending on ambient conditions, such as the ambient temperature, humidity, and atmospheric pressure. Sensors located on the vehicle may detect these values and adjust $CTF_{opt}$ based on the ambient conditions. The fuel quality, measured by octane rating or some comparable metric, may also influence the $CTF_{opt}$ value.

The present application describes various engine controller implementations that take into account the above issues to provide fuel efficient operation with acceptable NVH characteristics. In some embodiments, for example, an engine controller uses a factor indicative of the engine or working chamber requested output (e.g., cylinder torque fraction, mass air charge (MAC), air per cylinder, brake torque, cylinder load, net mean effective pressure, or any other parameter related to engine or working chamber output) to help determine a firing frequency, firing fraction, pattern, sequence or other firing characteristic. Some implementations involve an engine controller that does not determine a firing frequency based on the assumption that a particular fixed or maximum amount of air needs to be delivered to each fired cylinder. Instead, the engine controller considers the possibility of different air charge or working chamber output levels when determining a firing fraction or other firing characteristic. Generally, the engine controller is arranged to avoid or select particular firing frequencies, firing fractions, firing patterns or firing sequences, depending on current or anticipated operating parameters or engine settings.

An engine controller may use a lookup table, a control algorithm, or another mechanism that takes into account differing vehicle operating parameters or conditions when determining the acceptable NVH limit. The engine controller may use a lookup table to determine an appropriate firing fraction for operating the engine, given current and/or anticipated operating parameters. These and other embodiments will be described below with reference to the figures.

A general goal of any skip fire engine controller or skip fire engine control method is to deliver the requested engine output while minimizing fuel consumption and providing acceptable NVH performance. This is a challenging problem because of the wide range of operating conditions encountered during vehicle operation. A requested engine output may be expressed as a torque request at an engine operating speed. It should be appreciated that the amount of engine torque delivered can be represented by the product of the firing frequency and the cylinder load. Thus, if the firing frequency (FF) is increased, the cylinder load (CTF) can be decreased to generate the same engine torque, and vice versa. In other words, $$\text{Engine Torque Fraction (ETF)} = \text{CTF} * \text{FF} \quad \text{(Eq. 1)}$$

where the ETF is a value that represents normalized net or indicated engine torque. In this equation all values are dimensionless, which allows it to be used with all types of engines and in all types of vehicles. That is, to deliver the same engine torque, a variety of different firing frequencies and CTF combinations may be used. Equation 1 does not include the affects of engine friction. A similar analysis could be done including friction. In this case the calculated parameter would be brake torque fraction. Either engine net torque fraction, engine brake torque fraction, engine indicated torque fraction, or some similar metric can be used as the basis of a control algorithm. For clarity the term engine torque fraction can refer to any of these measures of engine output and will be used in the subsequent discussion of engine controllers and engine control methods.

FIG. 3 shows an exemplary table 340 compiling the most fuel efficient operating firing frequency, denoted as a base firing frequency ($FF_{base}$), for a range of engine torque fractions (ETFs) and engine speeds. The firing frequency is defined as the ratio of cylinder firings relative to the firing opportunities, i.e. all cylinder operation. Each column 350 in FIG. 3 corresponds to an engine speed and each row 360 corresponds to an engine torque fraction. Each table entry 370 represents the base firing frequency, $FF_{base}$, which is the firing frequency that provides the most fuel efficient operation at the specified engine speed and torque request. The base firing frequency can readily be calculated using equation 1 in conjunction with knowledge of ($CTF_{opt}$) at different engine speeds (see FIG. 2). Two general trends are evident in base firing frequency behavior. First, for fixed engine speed as the engine torque request increases the base firing frequency increases to match the required load. Secondly, for a fixed ETF as the engine speed increases the base firing frequency decreases. This reflects the fact shown in FIG. 2 that the cylinder loading which provides optimum fuel efficiency tends to increase as the engine speed increases. These trends will generally be present in all internal combustion engines; however, the exact values of the base firing frequency will vary depending on details of the engine design. Entries without a value cannot deliver the requested torque at ($CTF_{opt}$), since the firing frequency cannot be greater than 1. In order to deliver these torque levels, the cylinders will need to be operated with CTF values greater than $CTF_{opt}$. However, even in these situations skip fire operation is generally more efficient than conventional engine control, since skip fire operation allows the cylinder load to more closely match $CTF_{opt}$. While it is generally advantageous for the $FF_{base}$ values in FIG. 3 to represent the most fuel efficient firing fraction to deliver the request engine torque, other criteria may be used to define $FF_{base}$.

Figure 4:
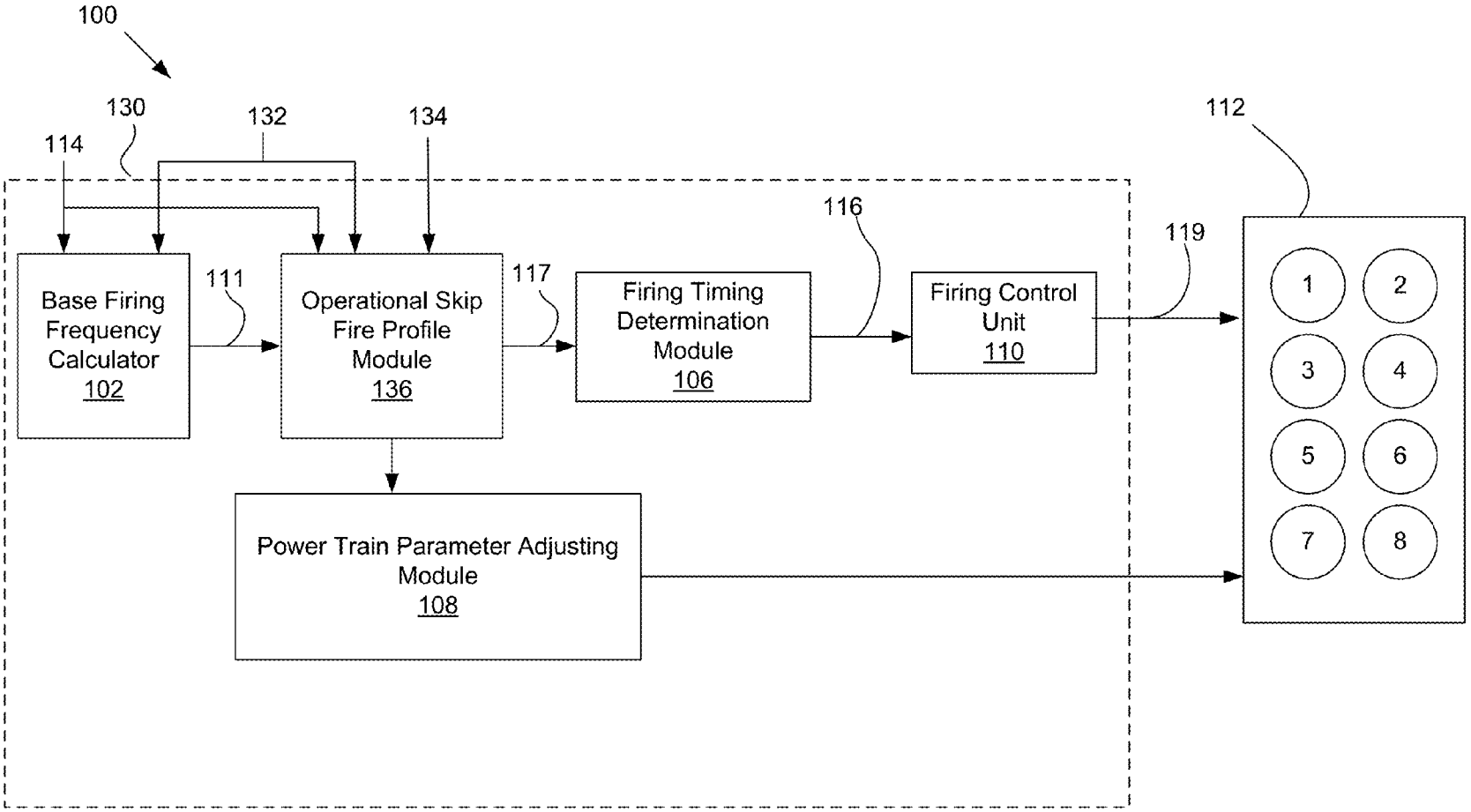
FIG. 4 is a block diagram illustrating an engine controller according to a particular embodiment of the present invention.

Referring to FIG. 4, an engine 100 according to a particular embodiment of the present invention will be described. The engine 100 consists of an engine controller 130 and the working chambers of the engine 112. The engine controller 130 receives an input signal 114 representative of the desired engine output and various vehicle operating parameters, such as an engine speed 132 and transmission gear 134. The input signal 114 may be treated as a request for a desired engine output or torque. The signal 114 may be received or derived from an accelerator pedal position sensor (APP) or other suitable sources, such as a cruise controller, a torque calculator, etc. An optional preprocessor may modify the accelerator pedal signal prior to delivery to the engine controller 130. However, it should be appreciated that in other implementations, the accelerator pedal position sensor may communicate directly with the engine controller 130. The engine controller 130 may include a base firing frequency calculator 102, an operational skip fire profile module 136, a power train parameter adjustment module 108, a firing timing determination module 106, and a firing control unit 110. The engine controller 130 is arranged to operate working chambers of the engine 112 in a skip fire manner.

The base firing frequency calculator 102 receives input signal 114 (and when present other suitable sources) and engine speed 132 and is arranged to determine a base firing frequency 111 that would be appropriate to deliver the desired output. The base firing frequency 111 is the firing frequency that delivers the requested torque at the most fuel efficient firing frequency and cylinder load as described relative to FIG. 3.

The base firing frequency 111 is input into the operational skip fire profile module 136. The operational skip fire profile is determined based at least in part on the engine speed 132 and transmission gear 134, which are both inputs to the operational skip fire profile module 136. The input signal 114 may also serve as an input to the operational skip fire profile module 136. The operational skip fire profile module 136 determines an operational skip fire profile. The operational skip fire profile includes both an operational firing fraction ($FF_{op}$) and a factor indicative of working chamber output, such as cylinder torque fraction, CTF. Other indicators of cylinder load may be used in place of cylinder torque fraction, such as brake torque, cylinder load, net mean effective pressure, air per cylinder (APC), mass air charge (MAC) or any other parameter that is related to working chamber output. In various embodiments, the determination of the operational skip fire profile is based on various operating parameters, including but not limited to engine speed, transmission gear, road conditions, driver settings, accelerator pedal position and the rate of change of the accelerator pedal position The operational skip fire profile module 136 takes into account multiple possible working chamber output levels when determining a suitable firing fraction. There are a wide variety of ways in which the operational skip fire profile module 136 can take into account different possible working chamber output levels. In some embodiments, for example, the operational skip fire profile module 136 references one or more lookup tables. The lookup tables may contain entries that indicate allowable engine speeds, cylinder loads and/or other engine parameters for particular firing fractions or frequencies (e.g., as illustrated in FIGS. 6 and 7.) One or more possible skip fire firing profiles are evaluated using the lookup tables. Each skip fire firing profile produces a desired engine torque via some combination of firing frequency and cylinder torque fraction. Some of these skip fire firing profiles will produce unacceptable NVH over certain engine speed ranges and gear settings and will be excluded from consideration as the operational skip fire profile. Among the remaining skip fire profiles the operational skip fire module 136 may advantageously select the skip fire profile having the best fuel efficiency as the operational skip fire profile. Alternatively the operational skip fire module 136 may use alternative criteria for making the determination of the operational skip fire profile.

In the illustrated embodiment shown in FIG. 4, a power train parameter adjusting module 108 is provided that cooperates with the operational skip fire profile module 136. The power train parameter adjusting module 108 directs the engine working chambers 112 to set selected power train parameters appropriately to ensure that the actual engine output substantially equals the requested engine output at the operational firing fraction. For example, if the operational skip fire profile module 136 determines that a higher firing fraction may be used, but would require the use of a lower working chamber output level or air charge, the power train parameter adjusting module would help ensure that a suitable, lower amount of air is delivered to the fired working chambers. The power train parameter adjusting module 108 may be responsible for setting any suitable engine setting (e.g., mass air charge, spark timing, cam timing, valve control, exhaust gas recirculation, throttle, etc.) to help ensure that the actual engine output matches the requested engine output.

The firing timing determination module 106 receives the operational firing fraction 117 from the operational skip fire profile module 136 and is arranged to issue a sequence of firing commands that cause the engine to deliver the percentage of firings dictated by an operational firing fraction 117. The sequence of firing commands (sometimes referred to as a drive pulse signal 116) outputted by the firing timing determining module 106 are passed to the firing control unit 110 which orchestrates the actual firings through firing signals 119 directed to the engine working chambers 112.

It should be appreciated that the engine controller 130 is not limited to the specific arrangement shown in FIG. 4. One or more of the illustrated modules may be integrated together. Alternatively, the features of a particular module may instead be distributed among multiple modules. The engine controller may also include additional features, modules or operations based on other patent applications, including U.S. Pat. Nos. 7,954,474; 7,886,715; 7,849,835; 7,577,511; 8,099,224; 8,131,445; 8,131,447; and 8,616,181; U.S. patent application Ser. Nos. 13/774,134; 13/963,686; 13/953,615; 13/953,615; 13/886,107; 13/963,759; 13/963,819; 13/961,701; 13/963,744; 13/843,567; 13/794,157; 13/842,234; 13/654,244, 13/654,248 and 13/654,244 and; and U.S. Provisional Patent Application Nos. 61/080,192; 61/104,222; and 61/640,646, each of which is incorporated herein by reference in its entirety for all purposes. Any of the features, modules and operations described in the above patent documents may be added to the illustrated engine controller 130. In various alternative implementations, these functional blocks may be accomplished algorithmically using a microprocessor, ECU or other computation device, using analog or digital components, using programmable logic, using combinations of the foregoing and/or in any other suitable manner.

Figure 5:
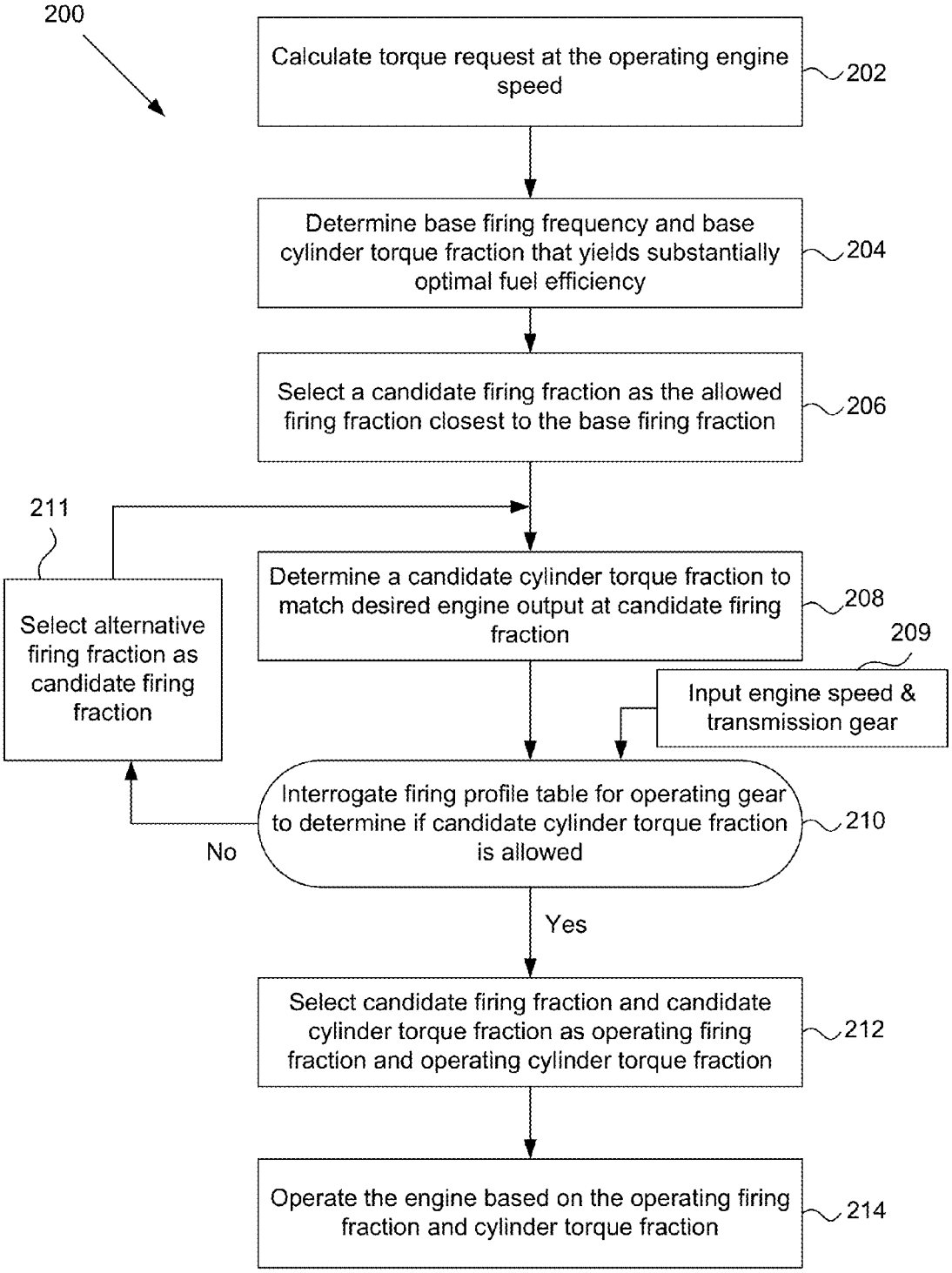
FIG. 5 is a flow diagram of a method for selecting an operational skip fire firing profile according to a particular embodiment of the present invention.

Referring next to FIG. 5, a method for determining an operational skip fire profile 200 according to a particular embodiment of the present invention will be described. The operational skip fire profile consists of an operational firing fraction and cylinder torque fraction or some equivalent measure of cylinder output. In various embodiments, the operational skip fire profile module 136 and/or the engine controller 130 perform the steps of FIG. 5.

At step 202, a torque request is determined based on input signal 114 (from FIG. 4) and the current engine operating speed. The input signal 114 is derived from any suitable sensor(s) or operating parameter(s), including, for example, an accelerator pedal position sensor.

At step 204, the base firing frequency calculator 102 determines a base firing frequency and base cylinder torque fraction. The base firing frequency and base cylinder torque fraction is the combination that yields the optimum fuel efficiency while delivering the requested torque. The operational skip fire profile module 136 then selects a candidate firing fraction from a set of available firing fractions (step 206). The candidate firing fraction may be the firing fraction closest to the base firing frequency. The operational skip fire profile module 136 then determines a candidate cylinder torque fraction from the torque request and candidate firing fraction using Eq. 1 (step 208).

The operational skip fire profile module 136 then interrogates a firing profile table to determine whether the candidate firing fraction and cylinder torque fraction are allowed (step 210). Inputs to this decision are the current engine speed and transmission gear (step 209). If the candidate torque fraction is allowed for this candidate firing fraction the process moves to step 212 where the candidate firing fraction and candidate cylinder torque request are selected as the operating firing fraction and operating cylinder torque fraction, i.e. the operational skip fire firing profile. The process then moves to step 214 where the engine is operated using the operational skip fire firing profile.

If in step 210 it is determined that the candidate cylinder torque fraction is unacceptable, the process proceeds to step 211 where a new candidate firing fraction is selected. The process then proceeds again to step 208 where the cylinder torque fraction associated with the new candidate firing fraction is calculated. A determination is then made if this new skip firing profile is acceptable (step 210). This loop proceeds until an acceptable candidate firing fraction is selected. Once this occurs the process proceeds through steps 212 and 214 as previously described.

A lookup table may be used in step 210 of FIG. 5 to determine whether the candidate cylinder torque fraction for the candidate firing fraction is allowed. FIG. 6 is a sample lookup table 300. Each row in the lookup table 300 corresponds to a particular firing fraction or firing frequency. In this example, each row indicates a maximum allowed cylinder torque fraction for a corresponding firing fraction. For any given firing fraction, the maximum allowed CTF may differ based on engine speed and/or other parameters. The rows may be arranged in ascending order from the lowest operating firing fraction, 1/9, to the highest firing fraction, 1. In table 300 all firing fractions with denominators of 9 or less are allowed. It should be appreciated that is some cases lower and higher maximum values for the firing fraction denominator may be used. Associated with each row is a maximum CTF value associated with each engine operating speed. In some cases it may be possible to provide a single CTF limit for each firing fraction without reference to the engine speed.

As an aid in understanding use of the look up table 300 shown in FIG. 6, consider a specific example of a torque request of 0.10 and an engine speed of 1000 rpm (this corresponds to the entry 370 in FIG. 3). From FIG. 3 the base firing frequency is 0.211. Interrogation of the lookup table 300 shows that the closest firing fraction to the base firing frequency is ⅕ or 0.200. This is selected as the candidate firing fraction (step 206). From equation 1 the required cylinder torque fraction may be determined as 0.1/0.200 or 0.5. The look up table 300 may then be interrogated to determine if a CTF of 0.5 is acceptable. In this case the value in the CTF limit table 372 is 0.06, so a CTF of 0.5 is unacceptable and a new candidate firing fraction must be selected as indicated in step 211. This may be done in multiple ways. One method is to increase the candidate firing fraction to the adjacent higher value, equivalent to stepping down a row in table 300, and repeating the process. In this case, the new candidate firing fraction would be ⅔ and the corresponding candidate CTF would be 0.1/(⅔) or 0.45 (step 208). Interrogation of table 300 (step 210) indicates that the appropriate maximum CTF value 373 is 0.03, so the candidate cylinder torque fraction of 0.45 is again unacceptable. The candidate firing fraction may again be incremented (step 211) and the new firing fraction is ⅓. The corresponding candidate CTF is 0.1/(⅓) or 0.3. Interrogation of table 300 (step 210) indicates that the appropriate maximum CTF value 374 is 0.51, so the candidate cylinder torque fraction of 0.3 is acceptable. The candidate firing fraction and cylinder torque fraction can then be selected as the operating firing fraction and cylinder torque fraction (step 212). The engine may be operated with this firing fraction and cylinder torque fraction (step 214).

Other search methods may be used in table 300 to determine an acceptable skip fire firing profile. For example, instead of incrementing the firing fraction to the next higher allowed firing fraction if the candidate firing fraction is unacceptable, the algorithm could move to the next closest firing fraction to the base firing frequency. This may be a smaller firing fraction than the original candidate firing fraction. Also, instead of choosing the firing fraction closest to the base firing frequency as the initial candidate firing fraction, the algorithm could select the closest firing fraction having a value greater than the base firing frequency. The search for an acceptable skip fire firing profile need not start with selecting the candidate firing fraction closest to the base firing frequency. Other search methods may be used with the goal of finding an acceptable skip fire firing profile with operating conditions at or near those that give rise to optimal fuel efficiency.

In general, acceptable skip fire firing profiles will be found by moving to higher firing fractions, since the associated cylinder torque fraction will be lower. In the extreme case the firing fraction moves to 1 and the engine operates on all cylinders, just as a conventionally controlled engine. An important advantage of various implementations of the present invention is the ability to operate the engine at an acceptable NVH at firing fractions at or close to the base firing frequency, which results in improved fuel economy.

An advantage of various embodiments of the present invention is that they take into account cylinder load and fuel efficiency in determining an acceptable firing fraction. That is, they do not necessarily assume that firing cylinders need to be operated at or near their optimal efficiency. In some cases, an undesirable frequency can still be acceptable, if its amplitude is sufficiently low. Various embodiments recognize when operating at reduced cylinder loads the NVH is lower than operating at the cylinder load corresponding to optimum fuel efficiency. This allows access to firing fractions that are closer to the base firing frequency and thus yields improved fuel efficiency.

There are a variety of methods that the information displayed in table 300 (FIG. 6) may be presented and interrogated. Table 300 is a two-dimensional table with the entries corresponding to the maximum allowed CTF at any given firing fraction and engine speed for a given transmission gear. The information can alternatively be expressed as a one-dimensional table where each row of the table lists a firing fraction and maximum CTF. This means that the list of data encompassing the maximum CTF and ranges of engine speed operation can be considered to be a single entry for purposes of this description. Associated with each entry are acceptable engine operating speeds. Different tables may be constructed for each transmission gear ratio. It should be appreciated for a vehicle with a continuously variable transmission, i.e. not having fixed gear ratios, the tables can be constructed for different ranges of transmission speed ratios. FIG. 7 shows a portion of such a table 700. Each row 740 corresponds to a firing fraction and maximum allowed cylinder torque fraction. The rows may be arranged first based on firing fraction and then on cylinder torque fraction as shown in FIG. 7, although other arrangements also may be used. Each row indicates the allowable engine operation speeds associated with a particular maximum allowed CTF and a firing fraction. In table 700 the acceptable engine speeds are depicted by a series of allowed ranges. For the values shown in table 700 up to three ranges are used, although more ranges and fewer ranges may be used in some cases. Alternatively, other methods of representing the allowed engine speeds may be shown. Generally as the CTF level decreases the allowable range of engine speeds increases, since the energy associated with each firing is reduced. Conversely, the allowed speed range narrows as the CTF is increased for a fixed firing fraction. This is consistent with the physical model shown in FIG. 1. In table 700 some engine speed range is acceptable for all listed firing fractions; however, in some situations a firing fraction may have no allowed engine speeds. For example, some firing fractions may be excluded when operating in a certain transmission gear.

The selection of an operational skip fire firing profile and/or corresponding firing fraction may be performed in a wide variety of ways. In various implementations, for example, a linear search or algorithm is used to navigate a lookup table to determine a suitable profile. In the lookup table 700 of FIG. 7, for example, the following algorithm may be used to find a suitable skip fire firing profile/firing fraction:

1) Start in the top row of the table.

2) Move to the next row until the firing fraction is larger than the base firing frequency.

3) In that row, look at the CTF limit column. If the value in the CTF limit column is smaller than the candidate CTF, go to step 4. Otherwise, repeat step 2.

4) If the current engine speed is outside of the allowed operating ranges in table 700, move to the next row and repeat step 3. Otherwise, stop here. The candidate firing fraction and corresponding cylinder torque fraction yield acceptable NVH performance while maximizing fuel efficiency. These conditions represent the operational skip fire firing profile. Note that under any condition, the row corresponding to a firing fraction of 1 is acceptable, so the search always ends successfully.

In various embodiments, the rows of the table are analyzed in the order of low-to-high firing fractions. That is, if the current operating conditions do not provide acceptable NVH performance, the operational skip fire profile module 136 then moves on to the row for the next highest firing fraction. A determination is again made as to whether the current operating parameters meet the acceptable NVH criteria, and the process continues until a suitable firing fraction is found and/or all the available profiles have been considered, which would revert engine operation to a firing fraction of 1. As a result, in some implementations, operational skip fire profile module 136 selects the operational skip fire firing profile with the lowest firing fraction that meets the following criteria: 1) the profile is suitable for delivering the desired torque; and 2) the current or anticipated operating parameters provide acceptable NVH performance for the selected firing fraction.

Once operational skip fire profile module 136 has selected a suitable operational skip fire firing profile, the firing timing determination module 106 (from FIG. 4) generates a firing sequence based on the selected profile (step 210 of FIG. 5). In some embodiments, for example, each profile corresponds to an available firing fraction. This operational firing fraction 117 is then received by the firing timing determination module 106. The firing timing determination module generates a firing sequence 116, which is sent to the firing control unit 110 based on the operational firing fraction 117. The firing control unit 110 in turn directs the working chambers of the engine 112 to operate in a skip fire manner based on the firing sequence 119.

In addition to presenting the acceptable skip fire firing profiles in a one-dimensional table like table 700 and a two-dimensional table like table 300, the acceptable profiles may also be compiled in a three dimensional table that lists engine speed, transmission gear, and firing fraction as the variables and maximum CTF as the table entry. This table contains information on which cylinder loads are allowed for each firing fraction, transmission gear setting, and engine speed. Similar tables can be constructed using different variables, but can provide substantially the same information, i.e. acceptable skip fire firing profiles for different vehicle operating conditions.

It should be appreciated that the lookup tables in the figures are only for illustrative purposes and that the concept of determining acceptable skip fire firing profiles may be implemented in a wide variety of ways. The format and structure of the data, the number of entries, the inputs to the lookup table, the number of lookup tables and the values in the lookup table can, of course, be modified to suit the needs of different applications. Generally, the data from the aforementioned tables can be stored in or involve any suitable mechanism, data structure, software, hardware, algorithm or lookup table that indicates or represents usage constraints for particular types of firing-related operations, characteristics or firing fractions.

In particular in some embodiments an operational skip fire profile may be determined without first determining a base firing frequency. In this case, a number of candidate skip fire profiles may be considered by the operational skip fire profile module 136 that deliver the requested torque. The operational skip fire profile module 136 may then select from these candidate skip fire profiles based on multiple criteria; including, but not limited to, NVH and fuel efficiency.

Figure 8:
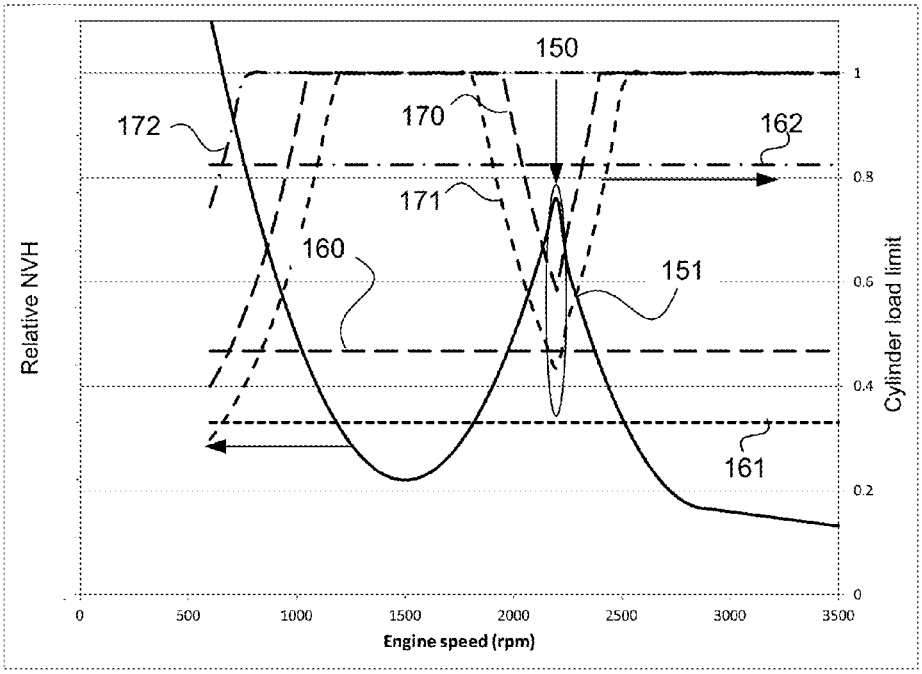
FIG. 8 is an exemplary plot of NVH versus engine speed for a selected firing frequency at maximum cylinder load and the resultant cylinder loading limits associated with various acceptable NVH levels.

In additional embodiments of the present invention multiple levels of acceptable NVH may be used. Selection of the appropriate NVH level may depend on many conditions such as a vehicle operating parameter, road roughness, cabin noise level, and/or user preference. FIG. 8 graphically depicts this embodiment. FIG. 8 is similar to FIG. 1 with the horizontal axis being engine speed, the left vertical axis being NVH level and the right vertical axis being the maximum acceptable cylinder load. As in FIG. 1 curve 151 corresponds to the maximum cylinder loading, i.e. CTF=1. Curve 151 has a resonance 150 at an engine speed of approximately 2200 rpm. In this case there are three different acceptable levels of NVH corresponding to curves 160, 161, and 162. Curve 161 corresponds to the most restrictive NVH criteria. Curve 162 corresponds to the least restrictive NVH criteria. Curve 160 corresponds to intermediate NVH criteria. Associated with the different acceptable NVH levels are the corresponding maximum cylinder loading limits. For the least restrictive NVH criteria, curve 162, the resulting maximum cylinder load curve is 172. In this case the engine is allowed to operate at maximum cylinder load for all engine speeds, except low speeds below approximately 750 rpm. For the most restrictive NVH criteria, curve 161, the corresponding maximum cylinder load curve is 171. In this case there are two ranges of engine speeds where operation at maximum CTF is allowed. The first range is between approximately 1150 and 1750 rpm and the second range is above 2500 rpm. At the intermediate NVH level of curve 160, the resulting maximum cylinder load limit curve is 170. This is the same case described in relation to FIG. 1. While FIG. 8 shows the acceptable NVH level in all cases to be independent of engine speed, this is not necessarily the case. For example, higher NVH levels may be acceptable at high engine speeds.

Figure 9:
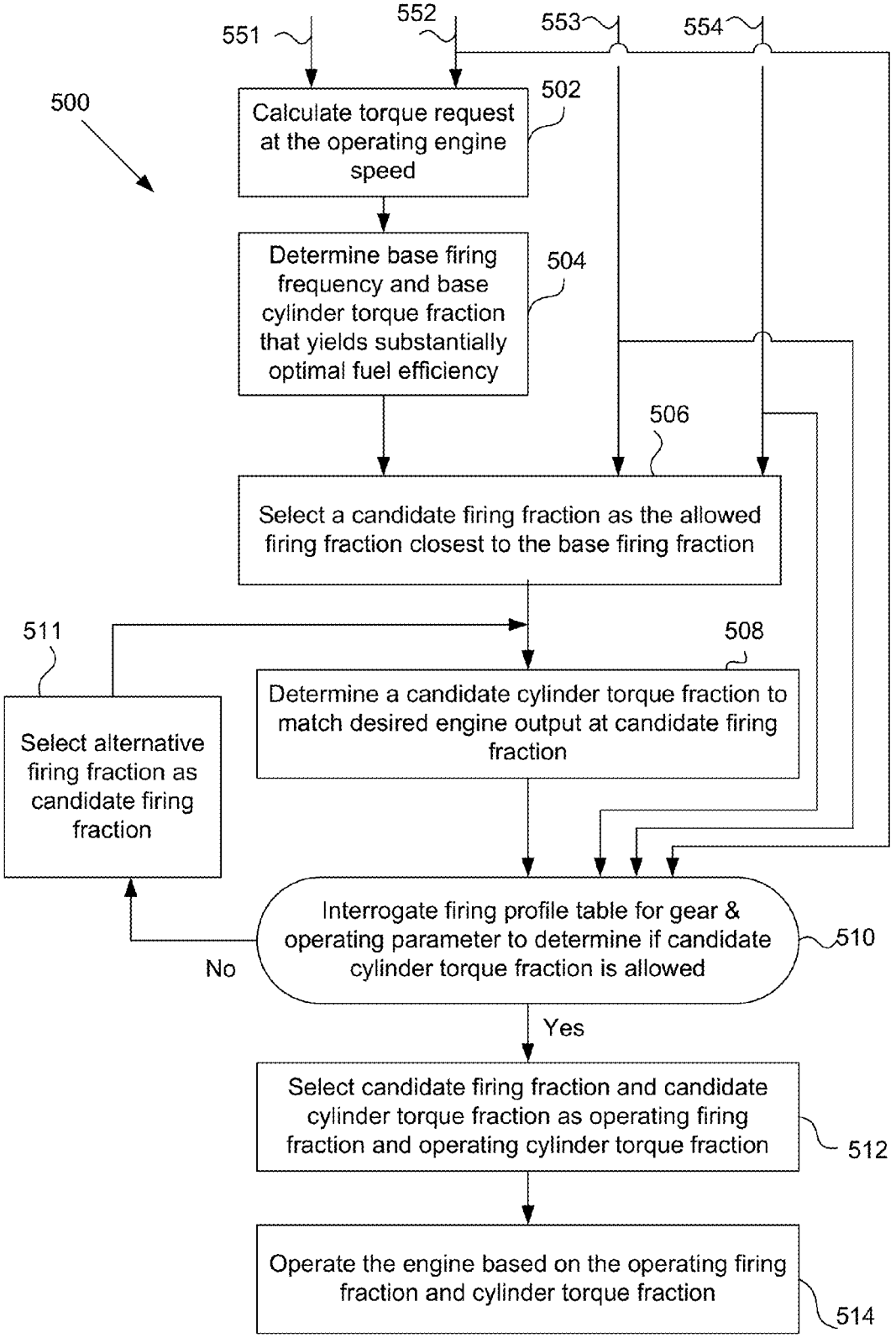
FIG. 9 is a flow diagram of a method for selecting an operational skip fire firing profile according to a particular embodiment of the present invention.

Referring next to FIG. 9, a method 500 for determining a skip fire firing profile according to the embodiment discussed relative to FIG. 8 will be described. The method 500 involves using one or more operating parameters to determine what constitutes an acceptable NVH level. This level can vary depending on the operating parameters, and thus the acceptable skip fire firing profiles may also vary.

In some situations, it is desirable to use more or less restrictive NVH criteria. The degree of restrictiveness may depend on the rate and direction of the accelerator pedal position change. Less restrictive NVH criteria may be applied when the pedal is tipped in and more restrictive criteria applied when the pedal is tipped out. Aggressive tip in indicates that the driver is rapidly demanding increasing torque from the engine and under these conditions acceptable NVH criteria may be relaxed. The degree of restrictiveness may also depend on or be affected by a wide variety of detected conditions e.g., when a shift between gears is detected, vehicle speed, road conditions, or when it is determined that the engine is in idle. Additionally, the criteria may depend on factors other than those associated with the engine power train, such as the roughness of the road or noise level in the vehicle cabin. In some cases the level of acceptable NVH may be selectable by the vehicle driver. The driver may make a tradeoff between the acceptable NVH level and fuel economy.

The illustrated method 500 provides one example implementation of the above approach. The illustrated method is similar to that described in relation to FIG. 5, with the exception of adding an operating parameter input that causes different look up tables or control algorithms to be used to determine acceptable skip fire firing profiles.

Inputs to the method 500 include a driver torque request or equivalent 551, an engine speed 552, a transmission gear 553, and a vehicle or user determined operating parameter 554.

At step 502, a torque request is determined based on torque request 551 and the current engine operating speed 552.

At step 504, a base firing frequency and base cylinder torque fraction are determined. The base firing frequency and base cylinder torque fraction is the combination that yields the optimum fuel efficiency while delivering the requested torque.

At step 506, a candidate firing fraction is selected from a set of available firing fractions. The available firing fractions may depend on the transmission gear setting 553 and the vehicle operating parameter 554. The vehicle operating parameter 554 may be any parameter that helps determine whether less or more restrictive NVH criteria should be used (e.g., the rate and direction of accelerator pedal position change, etc.).

At step 508 a candidate cylinder torque fraction is determined that would result in the engine producing the desired torque at the candidate firing fraction. The operational skip fire profile module 136 (FIG. 4) then determines a candidate cylinder torque fraction from the torque request and candidate firing fraction using Eq. 1. At step 510 a firing profile table is interrogated to determine whether the candidate firing fraction and cylinder torque fraction are allowed. The values (e.g., maximum CTF values, etc.) in the table, whose format and usage may resemble table 300 of FIG. 6 and table 700 of FIG. 7, may differ depending on the operating parameter 554. Inputs to the determination at step 510 are the current engine speed 552, transmission gear 553, and vehicle parameter 554. If the candidate torque fraction is allowed, the process moves to step 512 where the candidate firing fraction and candidate cylinder torque request are selected as the operating firing fraction and operating cylinder torque fraction, i.e. the operational skip fire firing profile. The process then moves to step 514 where the engine is operated using the operational skip fire firing profile.

If in step 510 it is determined that the candidate cylinder torque profile is unacceptable, the process proceeds to step 511 where a new candidate firing fraction is selected. The process then proceeds again to step 508 where the cylinder torque fraction associated with the new candidate firing fraction is calculated. A determination is then made if this new skip firing profile is acceptable (step 510). This loop proceeds until an acceptable candidate firing fraction is selected. Once this occurs, the process proceeds through steps 512 and 514 as previously described.

Figure 10:
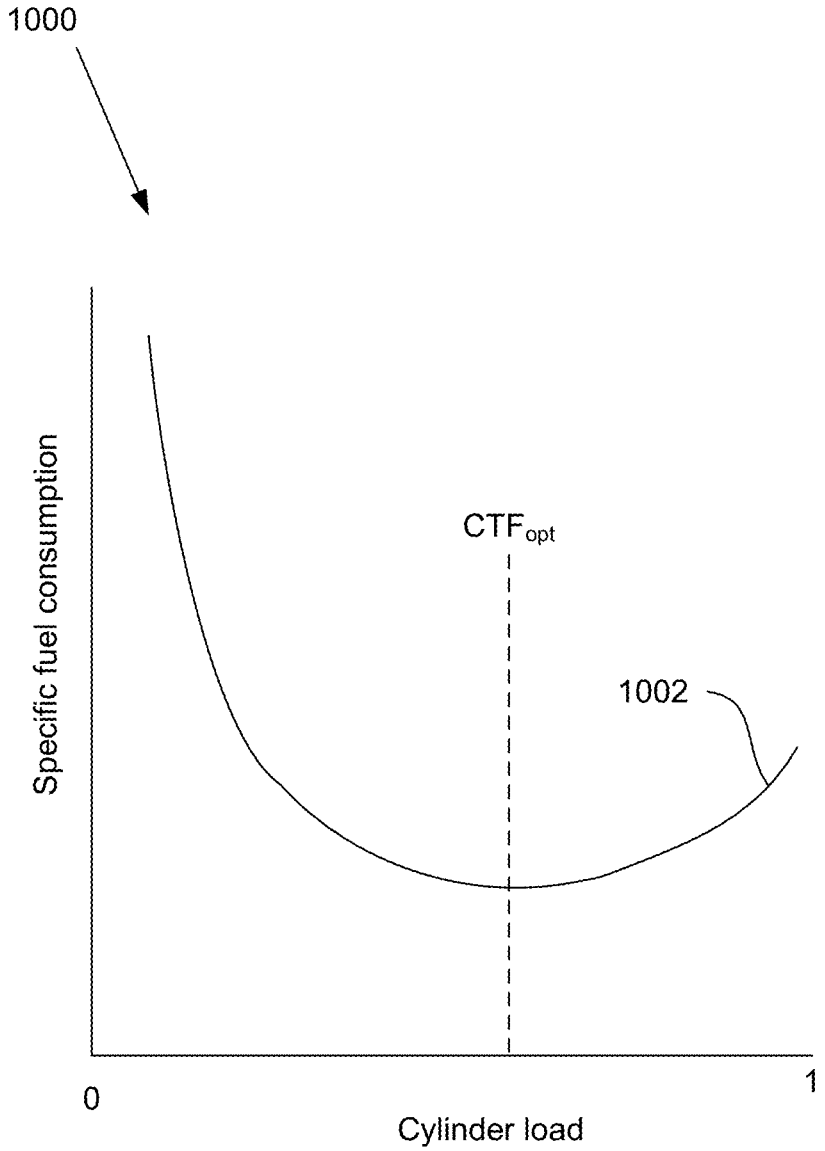
FIG. 10 is a graph indicating a relationship between specific fuel performance and cylinder load according to a particular embodiment of the present invention.

Referring next to FIG. 10, a graph 1000 indicating a relationship between cylinder load and fuel consumption according to a particular embodiment of the present invention will be described. The vertical axis for the graph 1000 corresponds to specific fuel consumption. The lower the specific fuel consumption, the greater the fuel efficiency. The horizontal axis for the graph 1000 corresponds to cylinder load. The optimally fuel efficient CTF level is indicated by a point on the curve 1002 that is labeled as $CTF_{opt}$. The curve 1002 assumes a particular engine speed and may vary as the engine speed changes. Other factors such as fuel quality, atmospheric pressure, ambient temperature and other external factors may influence curve 1002.

Some implementations of the present invention involve storing data indicated by the graph 1000 in a data structure at an engine controller 130. This cylinder load/fuel consumption data may be stored in any suitable data structure, including but not limited to a lookup table. The cylinder load/fuel consumption data may be provided for a wide range of engine speeds. The cylinder load/fuel consumption data helps indicate fuel usage or efficiency, given a particular engine speed, cylinder load and/or other engine parameter. The engine controller 130 may use the information on fuel efficiency stored in the look up table to determine the most fuel efficient operational skip fire firing profile.

The data may be used in a wide variety of ways. In some embodiments, for example, multiple candidate firing fractions are selected. A candidate cylinder load is calculated for each of the candidate firing fractions such that each cylinder load-firing fraction combination delivers a desired engine output. The aforementioned cylinder load/fuel consumption data is then used to determine which of these combinations is the most fuel efficient. The most fuel efficient combination or skip fire firing profile is then used in operating the engine. In some embodiments, for example, the firing fraction selected in this manner is used as the base firing fraction, as described in step 204 of FIG. 5.

Any and all of the described components may be arranged to refresh their determinations/calculations very rapidly. In some preferred embodiments, these determinations/calculations are refreshed on a firing opportunity by firing opportunity basis although, that is not a requirement. In some embodiments, for example, the selection of an operational skip fire firing profile (e.g., step 212 of FIG. 5 or step 512 of FIG. 9) is performed on a firing opportunity by firing opportunity basis. An advantage of firing opportunity by firing opportunity control of the various components is that it makes the engine very responsive to changed inputs and/or conditions. Although firing opportunity by firing opportunity operation is very effective, it should be appreciated that the various components can be refreshed more slowly while still providing good control (e.g., the firing fraction determinations may be performed every revolution of the crankshaft, every two or more firing opportunities, etc.).

Aside from NVH considerations other considerations may influence the choice of an acceptable operational skip fire firing profile. For example, in some cases it may be desirable to decrease the intake manifold pressure for a period of time to supply vacuum for various vehicle components, such as the power brakes. In this case operation at the skip fire firing profile which provides for optimum fuel efficiency would be prohibited, since it would not draw significant manifold vacuum. Different look up tables or a different search algorithm could be used to determine the skip fire firing profile which satisfies this intake manifold pressure constraint while simultaneously maximizing fuel economy. Similarly in the event of persistent engine knocking or malfunction of a given cylinder, different skip fire firing profiles may be used which substantially eliminate the engine knocking or avoid use of the malfunctioning cylinder.

It should be appreciated that the allowable firing fractions listed in table 600 and table 700 may be different for different gears, vehicle parameters, and driving conditions. For example less restrictive NVH constraints may allow more firing fractions than more restrictive NVH constraints. Also, not all combinations of numerator and denominator need to be included in a table. For example, in some situations 1/9 may be the only allowed firing fraction with a denominator of 9. Judicious choice of the allowable firing fractions may result in a more uniform distribution of allowed firing fraction.

The invention has been described primarily in the context of operating a naturally aspirated, 4-stroke, internal combustion piston engines suitable for use in motor vehicles. However, it should be appreciated that the described applications are very well suited for use in a wide variety of internal combustion engines. These include engines for virtually any type of vehicle—including cars, trucks, boats, aircraft, motorcycles, scooters, etc.; and virtually any other application that involves the firing of working chambers and utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkinson cycle engines, Wankel engines and other types of rotary engines, mixed cycle engines (such as dual Otto and diesel engines), hybrid engines, radial engines, etc. It is also believed that the described approaches will work well with newly developed internal combustion engines regardless of whether they operate utilizing currently known, or later developed thermodynamic cycles. Boosted engines, such as those using a supercharger or turbocharger may also be used. In this case the maximum cylinder load may correspond to the maximum cylinder air charge obtained by boosting the air intake.

It should be also appreciated that any of the operations described herein may be stored in a suitable computer readable medium in the form of executable computer code. The operations are carried out when a processor executes the computer code. Such operations include but are not limited to any and all operations performed by the firing fraction calculator 102, the firing timing determination module 106, the firing control unit 110, the power train parameter adjusting module 108, operational skip fire profile module 136, the engine controller 130, or any other module, component or controller described in this application.

Dynamic Skip Fire with Adjustments for N&V from Rough Roads and Acoustic Sources Referring back to FIGS. 4 and 7, the operational skip fire profile module 136 determines an operational firing fraction 117 consistent with the maximum allowed CTF. As previously discussed, the maximum allowed CTF is related to the restrictiveness of the NVH limit. A less restrictive NVH limit 162 (see FIG. 8) permits improvements in fuel economy.

In one embodiment, the engine controller 136 monitors at least one parameter indicative of Noise and Vibration (N&V) sources not related to the engine and power train. The monitoring of external N&V sources is used by the operational skip fire profile module 136 of engine controller 100 to determine conditions in which the CTF limits may be modified to adjust the firing fraction to achieve better fuel economy by, for example, allowing higher cylinder loads and thus higher fuel economy when there are external N&V sources that at least partially or completely mask a driver's perception of NVH generated by the engine.

There is a firing fraction at every engine speed and load condition which has the best fuel economy characteristics, but not necessarily the best NVH. At some engine speeds and load points there are some firing fractions, optimal for fuel economy, that exhibit noise and vibration (N&V), generated by the engine and power train, such that these firing fractions fall outside of the low powertrain generated noise and vibration tolerances set by some manufacturer's specifications. However, disallowing certain firing fractions creates a bigger jump or transition from one firing fraction to another, increasing the likelihood of causing a torque bump or sag during the transition. Disallowing these firing fractions also adversely affects fuel economy, since the CTFs are not optimized.

The powertrain generated noise and vibration tolerances permitted for any particular vehicle may vary in accordance with the manufactures specifications and can be quite low for some vehicle brands. Additionally, the noise tolerances are typically set for test conditions that are often far different than real world driving conditions. These low tolerances can result in certain firing fractions being excluded even though they perform quite well and would be acceptable to most drivers in real world driving conditions.

The low tolerances set by some manufacturer's specifications also mean that the NVH that would be generated by an "excluded" firing fraction may easily be masked by external sources during many driving conditions. For example, when a radio or other entertainment system is being played, the sounds levels generated by the entertainment system may be much higher than, and therefore mask, any potentially audible noises or perceptible vibration associated with skip fire operation at a potentially excluded firing fraction. Similarly, the vibration thresholds set by many manufacturers are based on very smooth road (test track) driving conditions where even very small vibrations may be perceptible to a trained driver. However, most normal driving conditions are on roads that are not as smooth as the design test conditions and therefore the NVH associated with a potentially excluded firing fraction may be masked by road generated noises/vibrations in many real world driving conditions.

N&V can be generated from many other sources besides the engine and the drive train. This external N&V may be large enough, under some circumstances, to mask the N&V caused by normally excluded firing fractions. For example, an excluded firing fraction that falls outside of the low N&V tolerance of a manufacturer's test on a smooth road surface may have N&V characteristics that are not discernible to a typical driver when driving on rough roads that generate comparable or greater N&V. Rough roads thus create N&V that may mask a driver's perception of the N&V of a firing fraction. This provides an opportunity to allow additional firing fractions on rough roads that would otherwise fall outside of the low tolerances of some manufacturer's specifications and gain back a fuel economy benefit. Apart from N&V due to rough roads, there are other potential N&V sources such as wind, tires, and entertainment system, etc. that can be large enough, in some circumstances, to cause N&V masking.

For example, if a vehicle is being driven in high wind conditions the wind may cause acoustic noise at high wind levels as well as vibration if there is a gusty wind condition. A car driven with the windows or sunroof open may also generate significant amounts of acoustic noise in the cabin of a vehicle from the flow of the air. In some driving environments, the noise generated from nearby cars and trucks may also generate significant amounts of acoustic noise in a vehicle cabin, particularly if a vehicle is being driven with an open window or open sunroof.

An entertainment system with the audio level cranked at a high volume may generate significant amounts of internal acoustic noise, which means that the occupants of the vehicle are less likely to perceive acoustic noise generated by the skip fire. Tires may also generate significant amounts of acoustic noise and even vibration under certain road and tire conditions, with an extreme example being when studded tires are used for winter driving. Some driving conditions, such as driving in a heavy rain, can also generate significant amounts of noise from the rain striking the roof, the tires running on a slick surface, and the noise from wiper blades. Other examples of sources of noise may include fans from environmental systems, such as heating, cooling, and defrosting systems. In one embodiment, one or more sources of external N&V (N&V generated external to the engine and power train) are monitored. A determination is made whether the external N&V masks the NVH generated by the engine and power train. For example, empirical studies may be used to determine levels at which most drivers would find that the external N&V is sufficiently high that they do not perceive a significant difference in driving experience from a particular NVH generated by the engine.

A masking determination may be a simple yes/no decision that the masking is above some threshold level. More generally, the degree of masking may be defined as a set of levels (e.g., low, medium, and high) or by a masking metric (e.g., a number on a scale). The masking may be for both N&V, for N, or for V. The masking determination and degree of masking, in turn, is then used to determine an acceptable level of NVH generated by the engine and power train. The NVH thus becomes less restrictive (more relaxed) when there is external noise and vibration. This permits the firing fraction selection to be adapted to minimize fuel consumption under the less restrictive acceptable NVH level. Allowing the extra fractions that would otherwise be disallowed increases the fuel economy and reduces emissions by allowing the engine to run more efficiently. Additionally, in one embodiment an economy mode input may be used to relax the NVH criteria.

Figure 11:
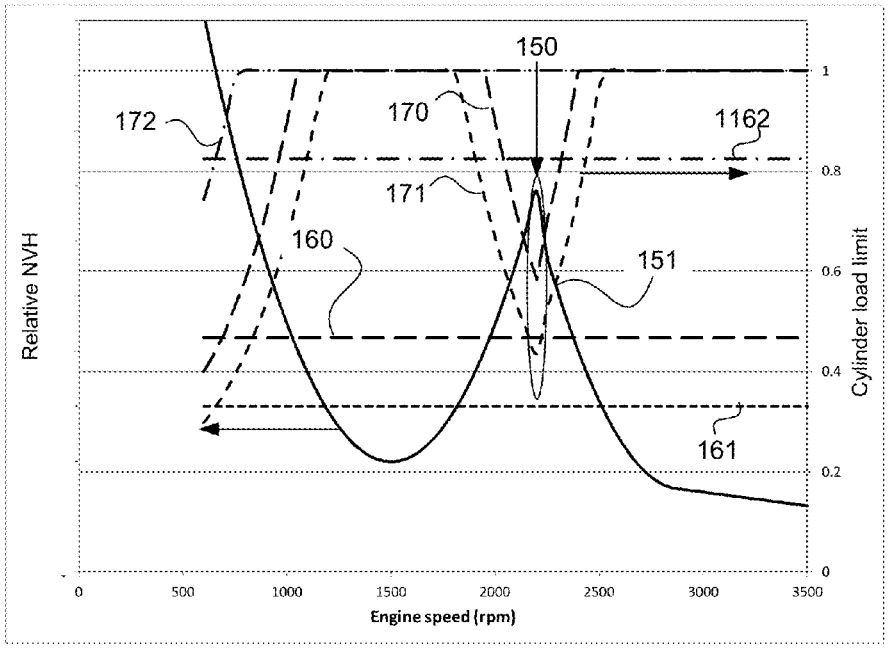
FIG. 11 an exemplary plot of NVH versus engine speed for a selected firing frequency at maximum cylinder load and the resultant cylinder loading limits associated with various acceptable NVH levels showing the influence of external noise and vibration (N&V) on the acceptable NVH level.

FIG. 11 is a variation of the plot of FIG. 8 illustrating that the acceptable NVH level 160 when there is no external noise or vibration is shifted to a less restrictive higher level 1162 when there is enough N&V generated external to the engine and power train to mask the engine generated NVH. The degree to which the acceptable NVH level 160 may be shifted to a less restrictive higher level 1162 will depend upon the contribution of external N&V sources.

Figure 12A:
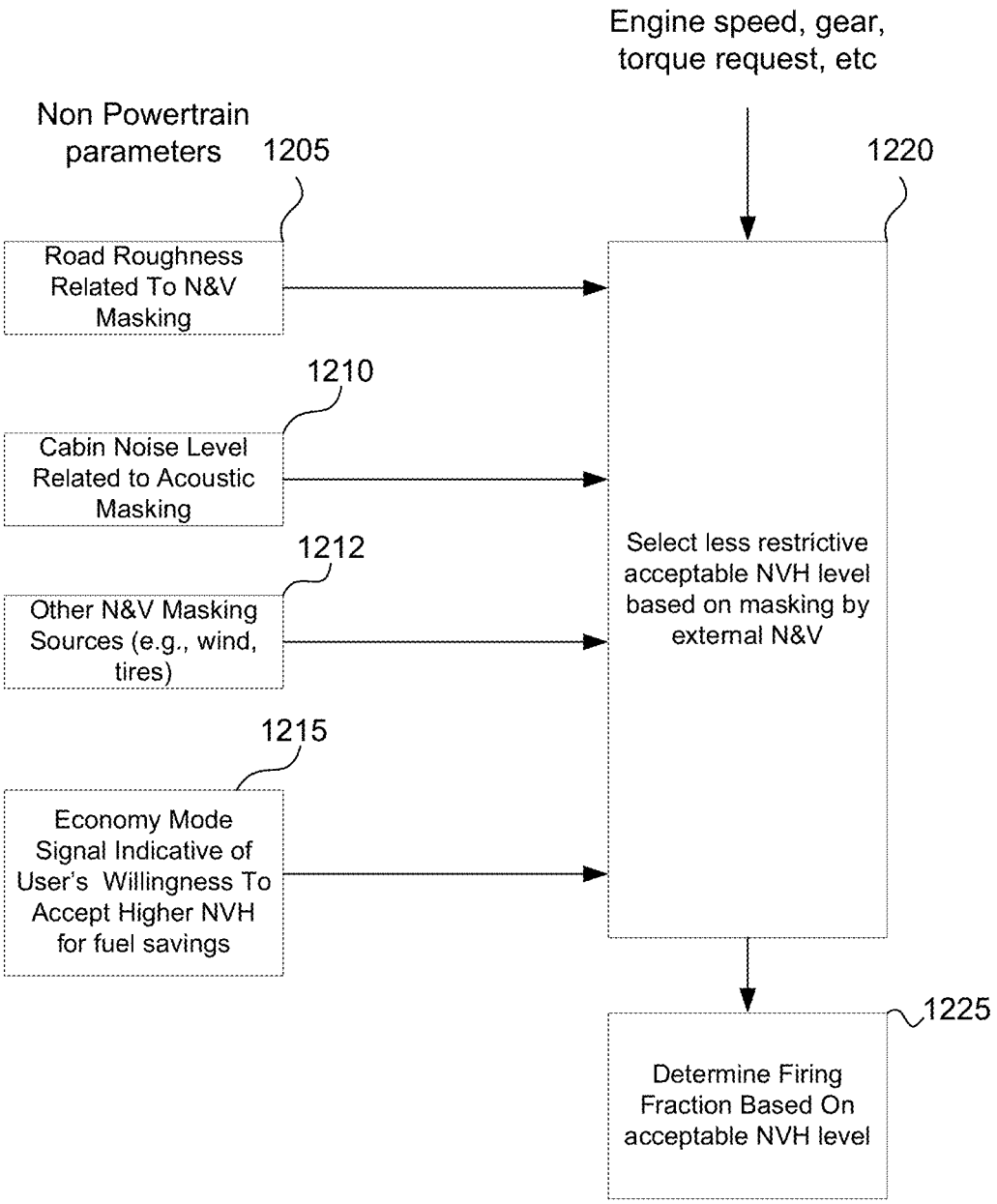
FIG. 12A illustrates a method of selecting less restrictive NVH levels based on road conditions and other factors in accordance to a particular embodiment of the present invention.

Referring to FIG. 12A, in one embodiment a method of adjusting the acceptable NVH level is based on at least one input. As an example, the at least one input may include a factor indicative of how the N&V generated by road roughness at a particular vehicle speed masks engine generated NVH 1205; an input indicative of how cabin noise, not generated by the engine or power train, creates acoustic masking of engine and power train induced NVH; an input indicative of other N&V sources 1212 (e.g., wind, tires), and an (optional) input 1215 indicative of an economy mode signal indicative of a user's willingness to accept higher NVH levels for fuel savings. The inputs 1205, 1210, 1212 and 1215 are used to determine whether a less restrictive NVH level 1162 may be utilized to increase fuel savings. A firing fraction is determined 1225 based on the less restrictive NVH level 1162.

While an exemplary set of inputs 1205, 1210, 1212, and 1215 are illustrated, it will be understood that more generally only at least one input affecting the restrictiveness of the NVH limit is required. Moreover, it will also be understood that the components could, in principle, be further defined to include separate contributions for wind, weather, tires or other components related to N&V not generated by the engine.

Figure 12B:
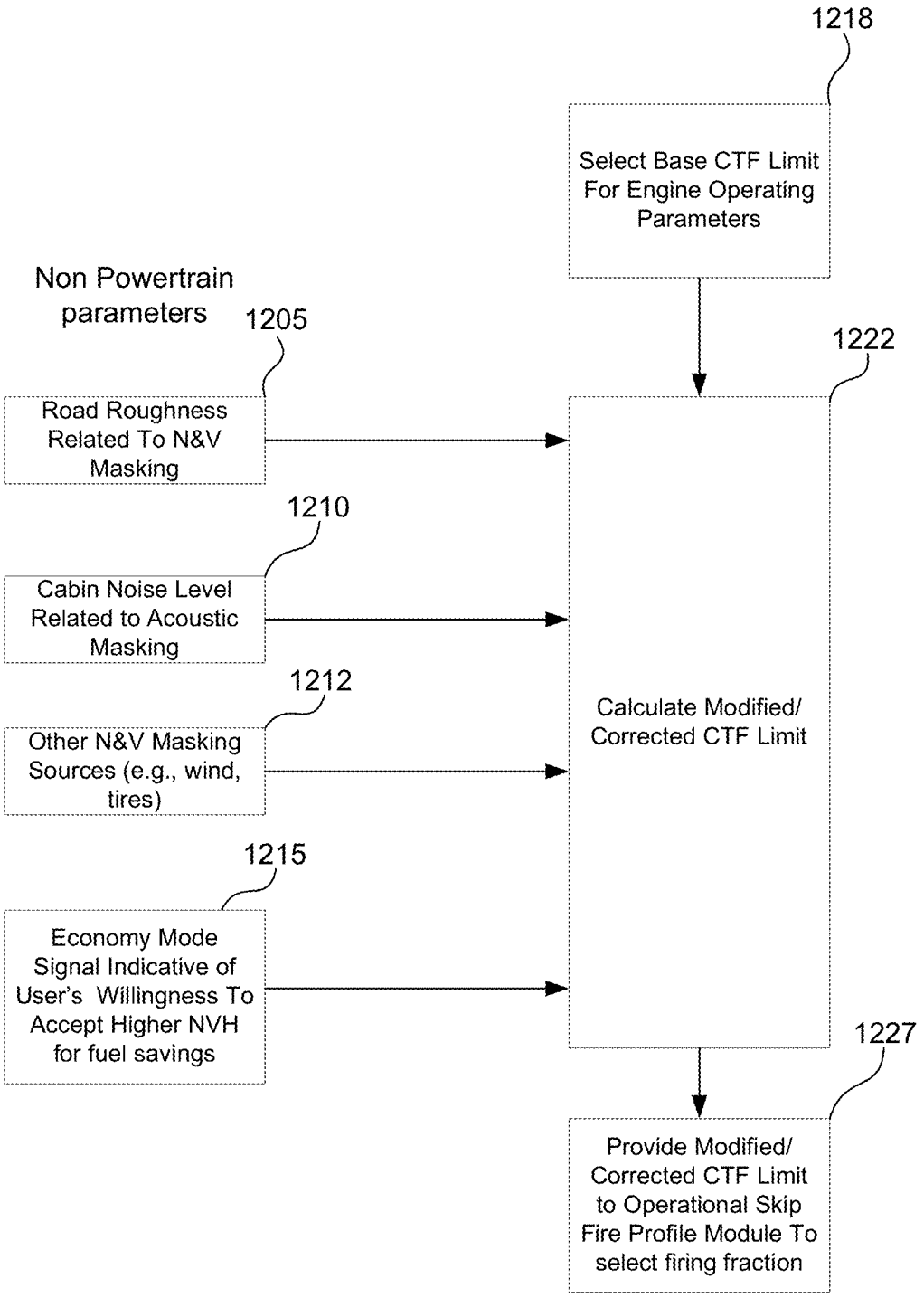
FIG. 12B illustrates a method of adjusting a CTF limit based on road conditions and other factors in accordance to a particular embodiment of the present invention.

The approach of FIG. 12A may be equivalently implemented with reference to determining adjustments to CTF limits when there is external N&V. Referring to FIG. 12B, in one embodiment of a method, the CTF limits used by operational skip fire profile module 136 (of FIG. 4) are modified from base CTF limits based on a determination of road roughness 1205, a noise level in the cabin not generated by engine and power train 1210, other N&V sources (e.g., wind, tires) or a user preference 1215 of an economy mode. The inputs 1205, 1210, 1212, and 1215 are used to calculate a modification 1222 to base CTF limits for the operating parameters of the engine. The calculated modification to the CTF limit is provided 1227 to the operational skip fire profile module 136 to select a firing fraction.

The modification to base CTF limits may be implemented in different ways. In one embodiment, a correction is made to base CTF limits 1218. Alternatively, a discrete number of different CTF limit tables may be supported and an appropriate CTF limit table selected based on the input signals indicative of external N&V and any user preference for an economy mode.

The roughness of a road can be characterized with respect to whether the roughness that satisfies some minimum threshold relevant to masking the N&V of at least one firing fraction. Roads having a relative roughness ("relative road roughness") high enough to at least partially mask the N&V of one or more firing fractions can be detected and characterized as a "rough road." As one example, a rough road may be defined as generating sufficient N&V, relative to test track conditions at the same vehicle speed, to mask at least one firing fraction. However, more generally, the rough road could be defined as generating a sufficient N&V to substantially mask at least one firing fraction, such as by masking a selected percentage of the N, V, or N&V of at least one firing fraction.

A rough road can be detected by in a variety of input signals in addition to vehicle speed. One technique to detect rough roads is to use the Anti-lock brake system (ABS) signal. ABS signals are sometimes used for the purpose of detecting rough roads in order to turn off ABS misfire detection diagnostics, which are exacerbated by rough roads. Another option is to include an accelerometer mounted on a suspension arm as another way to detect the road conditions. Another technique of road roughness detection is to analyze the crank shaft acceleration. In rough roads the crank acceleration signal is much noisier than on smooth roads. Analyzing this signal may be used give an indication of road roughness. Another technique is to utilize the TPM (Tire Pressure Monitor) sensors to observe fluctuations in pressure due to the change in the road surface. It will also be understood that two or more road roughness signals could be used in combination to determine road roughness.

Other types of sensors may also be employed as additional sources of information on road roughness. Global position system (GPS) data may be used an additional factor to determine vehicle acceleration and road roughness. The GPS data may be provided by a wireless connection. Sensors in the body of the vehicle, such as accelerometers, may be used to provide additional information on roughness. Other sources of information on road roughness, such as an Internet or cloud-based source, may also be accessed. For example, some non-paved roads are marked on online maps. Additionally, in some cases, information on roads that are rough due to construction or local road damage may be available online. Moreover, information relevant to road roughness may be obtained from other vehicles (e.g., GPS data, sensor data, calculated roughness, etc.), such as via a wireless connection.

A turn on and turn off response for adapting to rough roads may have a hysteresis selected based on user comfort. For example, in one embodiment the response to detect a rough road and change a firing fraction selection (a turn-on time) may be selected to be longer than a turn-off time to detect a transition back to a smooth road and adjust the firing fraction selection. Alternatively, in some embodiment the user may be provided a means to tune the turn on and turn off response. An exemplary turn-on time is about one second. An exemplary turn-off time is about one-half second.

Figure 13:
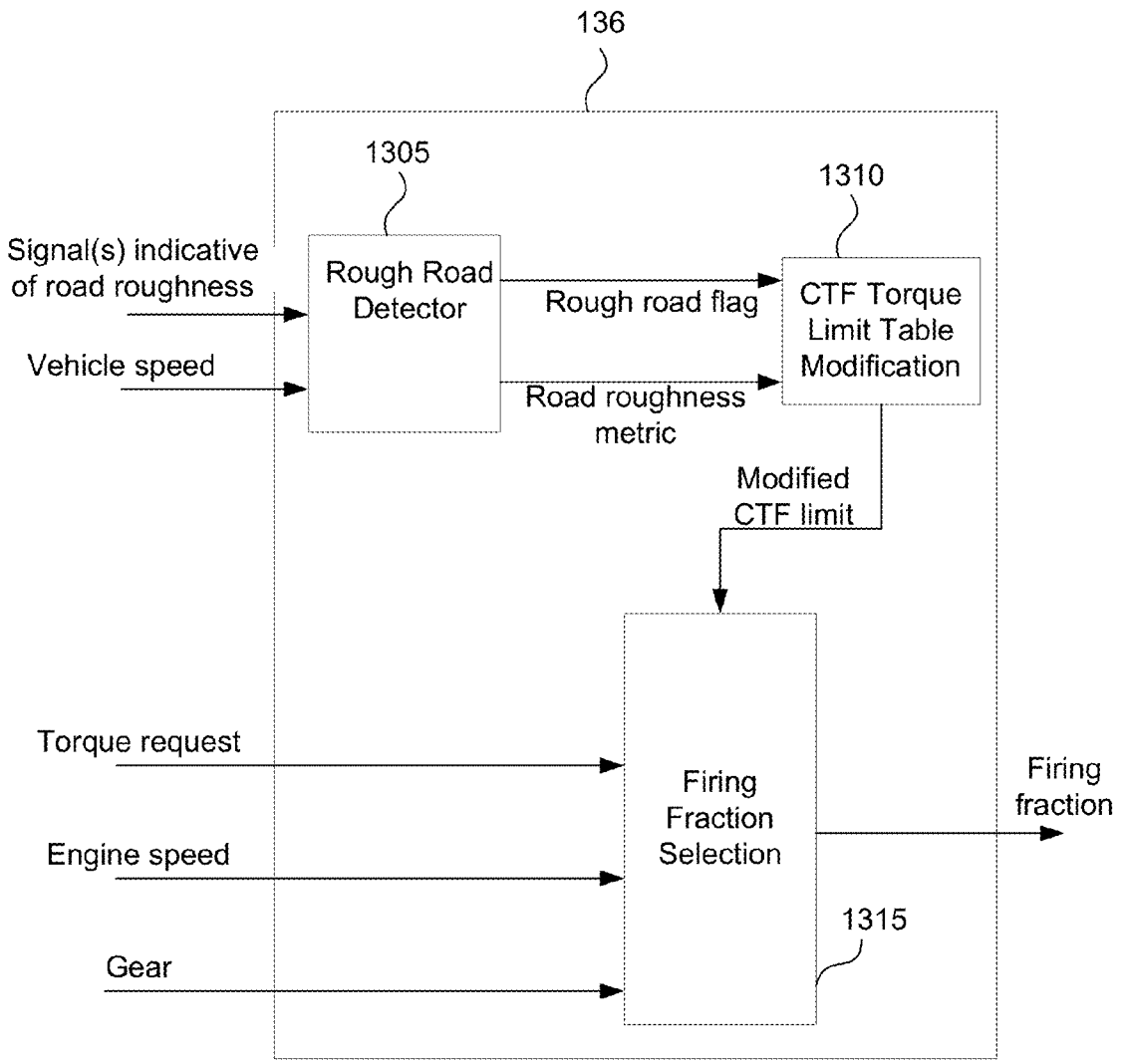
FIG. 13 illustrates an embodiment of an apparatus to vary a firing fraction in response to road conditions according to a particular embodiment of the present invention.

FIG. 13 illustrates an embodiment of apparatus to modify the firing fraction when there are rough roads. In one embodiment, a road roughness detector 1305 detects road roughness based on one or more input signals, which may include a wheel accelerometer signal and vehicle speed, although other signals could also be used. Noise and vibration generally increase with vehicle speed, even on a smooth road. Thus in one embodiment the vehicle speed is utilized in combination with other signals, such as wheel acceleration, to determine road roughness.

One embodiment, road roughness detector 1305 generates a rough road flag, a binary yes/no indicating that there is a rough road. Additionally, in one embodiment a road roughness metric is generated by the road roughness detector that is indicative of a degree of road roughness. This may be based on levels (e.g., 2, 3 or more road roughness levels) or be a road roughness number within a scale of road roughness). A CTF Torque Limit Table Modification Module 1310 utilizes the outputs of the road roughness detector 1305 to determine modified CTF/Torque limits based on the road roughness. The modified CTF/Torque limits are used by a firing fraction selector 1315 to select a firing fraction for the current engine operating parameters, such as a torque request, engine speed, and gear setting.

In one embodiment, the road roughness detector 1305, CTF/Torque Limit Modification Module 1310, and Firing Fraction selector 1315 are implemented as hardware, firmware, or software within the operational skip fire profile module 136. However, more generally one or more of these components may reside in other portions of engine controller 130.

Figure 14:
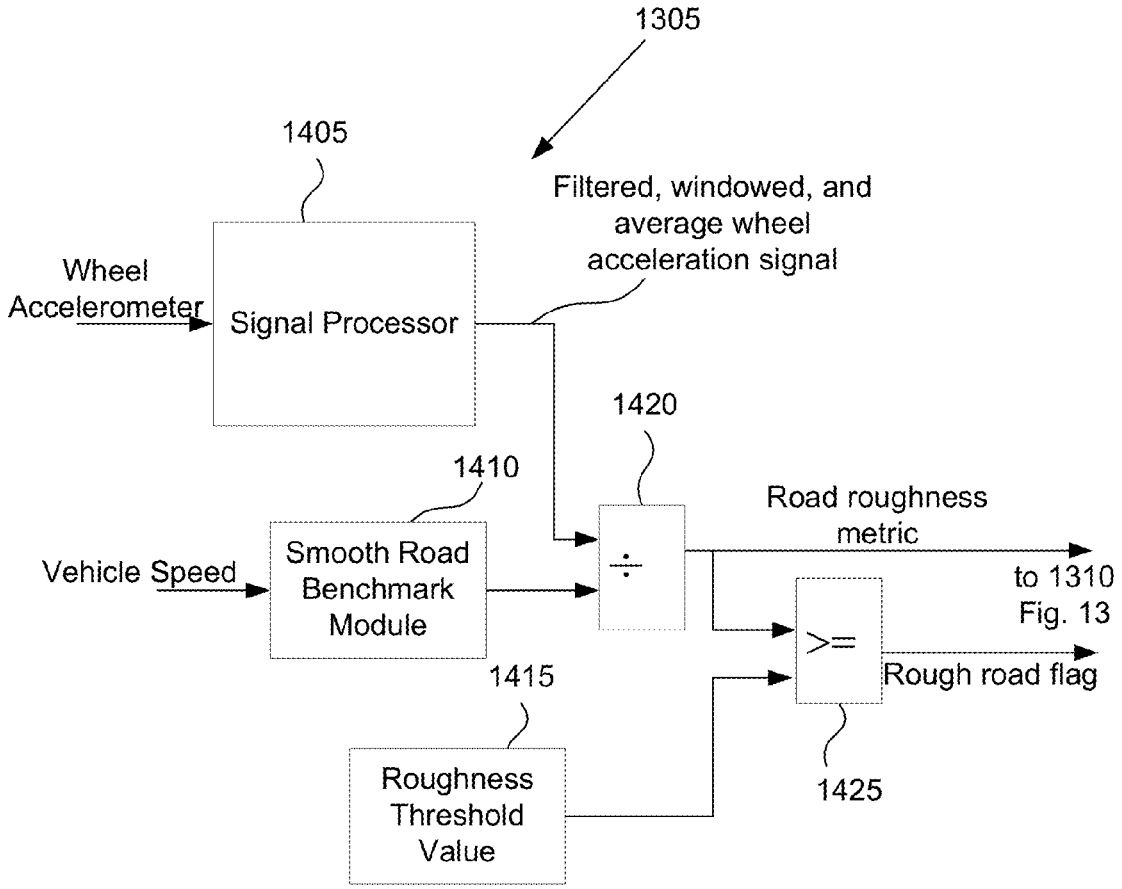
FIG. 14 illustrates an embodiment of a road roughness detector according to a particular embodiment of the present invention.

FIG. 14 illustrates in more detail an embodiment of a rough road detector 1305. A signal processor 1405 performs filtering, windowing, and averaging (for example, determining a root mean square (RMS) value) operations of an input signal, such as wheel acceleration, to generate a signal indicative of road roughness. A smooth road benchmark module 1410 is used to generate a smooth road benchmark signal indicative of noise and vibration generated on a smooth road at the current vehicle speed. The smooth road benchmark for a given vehicle speed may be determined using a lookup table or by using a formula. For example, wheel vibration levels at various vehicle speeds can be benchmarked on a smooth test track. This data can be converted to a look up table or a mathematical function of vehicle speed through curve fitting. In a real time controller implementation, the wheel acceleration is measured and signal processing is performed by signal processor 1405, where the signal processing may include filtering, windowing, and averaging operations. For example, the filtering, windowing, and averaging operations may be performed over a time scale on the order of a second or more. The processed signal is then scaled in module 1420 by the smooth road benchmark (e.g., by a division operation). Scaling wheel acceleration road roughness signal by the smooth road roughness signal produces a road roughness metric signal. The road metric signal, in turn, can be compared in a comparison module 1425 against a threshold value 1415 to generate a rough road flag (e.g., a binary 1 or 0) indicative of a rough road condition.

In this example, wheel acceleration and vehicle speed are use to determine a road roughness. The output may include a rough road flag (e.g., a binary 0 or 1) to indicate that the road roughness equals or exceeds a threshold value. Additionally, in one embodiment a road roughness metric (e.g., a multi-level scale having at least two levels or continuous/sliding scale) may be generated. The flag and the metric are then used to adjust the CTF/Torque limits relative to base values.

In one embodiment, the CTF/Torque limits are modified from a base calibration. The modified CTF limits are then used to select the best firing fraction to fire for maximum efficiency and acceptable NVH given the road masking levels for a given set of operating parameters, such as a torque request, engine speed, and gear.

Alternatively a discrete number of preloaded sets of CTF/Torque limit tables for various road roughness levels may be provided and used to adjust the CTF limit. For example, if the road roughness metric has three levels (e.g., low, medium, and high road roughness), then preloaded CTF limits may be provided for each level of road roughness.

In one embodiment, at least one of the road roughness and the acoustic noise levels is monitored to determine an adjustment to the allowed firing fractions. In one embodiment both road roughness detection and acoustic noise detection is performed to determine an adjustment to an allowed CTF that would otherwise be disallowed for N&V reasons.

In one embodiment, calibration tables are used to allow various firing fractions based on the severity of road roughness levels and noise levels corresponding to local N&V conditions. The calibration tables can be automatically selected depending on different calibration thresholds signifying the N&V severity.

In one embodiment, an "ECO" button can also be used, so that the driver can provide a user input that is used to allow some high NVH firing fractions as a trade-off to better fuel economy. A manually controlled ECO (economy) mode switch may be provided for the vehicle operator can choose to obtain higher fuel economy. For example, this manual option is useful in an emergency situation with a near empty tank to push the vehicle as far as possible before engine stall. Alternatively, in some embodiments a user may have the option of disabling adjustments to the operational skip fire firing profile based on external conditions.

Figure 15:
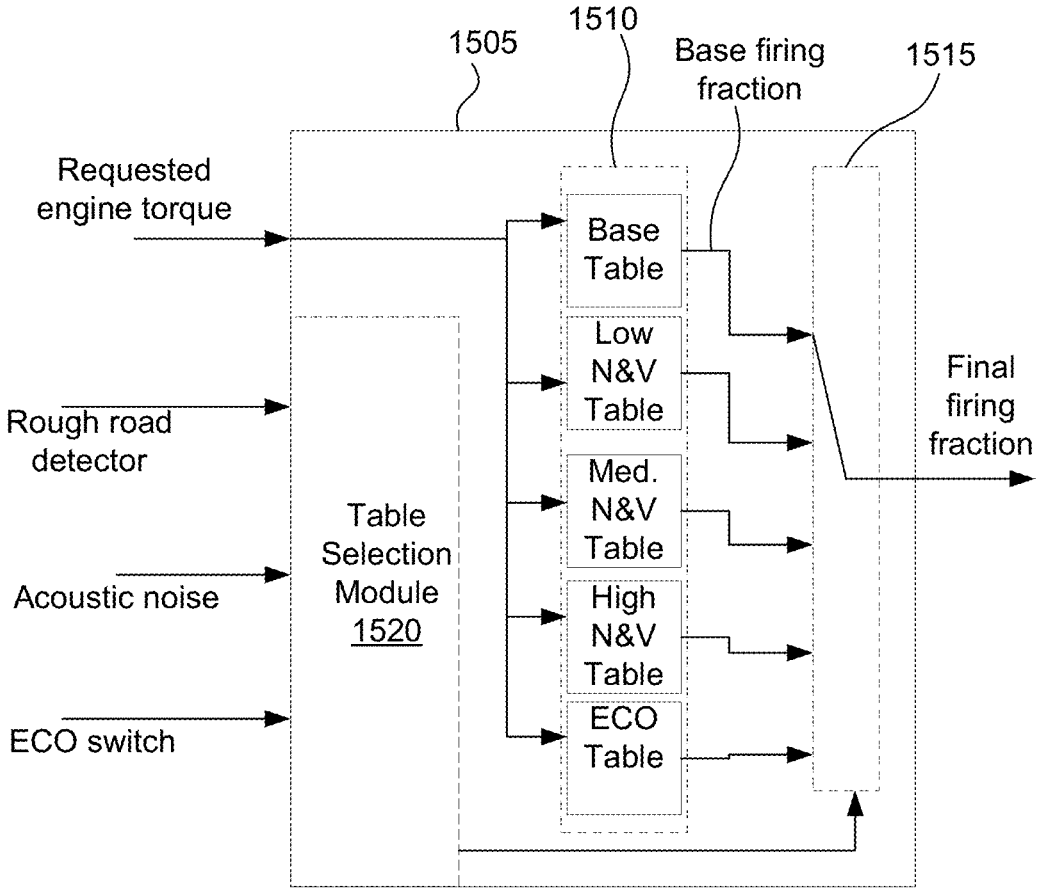
FIG. 15 illustrates an embodiment of an apparatus to base a firing fraction on noise and vibration severity according to a particular embodiment of the present invention.

FIG. 15 illustrates an embodiment in which a controller 1505 selects lookup tables to adapt the firing fraction based on the combination of inputs that determine N&V from external sources and optionally a user selection of an economy ("ECO") mode. Controller 1505 receives a first input signal or signals indicative of an engine torque request. Other inputs to controller 1505 may include one or more signals indicative of a rough road condition, signal(s) indicative of acoustic noise sources, and an economy mode input signal. These inputs may be directed into a table selection module 1520. The acoustic noise masking levels can be determined in a variety of different ways. For example, acoustic masking levels can be detected by using a microphone in the vehicle cabin to measure interior noise levels. For example, many vehicles include microphones for entering voice commands or for making phone calls. Additional information on contributors to cabin noise can be obtained through monitoring the audio signals going to the speaker system of the vehicle.

Each N&V level (low, medium (med.), and high in this example) has an associated calibration table that determines an acceptable firing fraction given the level of masking noise and vibration. Controller 1505 uses the inputs to select a calibration table, from a set of calibration tables 1510, to determine a final firing fraction. A switch 1515 may be used to make the selection. If no masking noise is present, the base firing fraction may be used directly as the final firing fraction. The controller 1505 determines an N&V severity level that may correspond to a set of one or more severity levels, such as low, medium, or high N&V. Each N&V level, in turn, has its own associated calibration table or tables to determine a firing fraction. In one embodiment, the ECO mode input has its associated set of calibration tables. The calibration tables may be preloaded, where each calibration table may be implemented as a set of n-dimensional (n-D) tables. Controller 1505 uses the inputs to select one or more calibration tables, from a set of calibration tables 1510, to determine a firing fraction. One or more input signals, such as an engine torque request, may be used to determine a base calibration (CPG) that corresponds to a first order selection of calibration tables to determine firing fraction for a given set of engine operating parameters when there is no external N&V. Other input are used to determine the degree to which there is N&V masking based on rough roads, acoustic masking, or other causes. The controller 1505 determines an N&V severity level that may correspond to a set of one or more severity levels, such as low, medium, or high N&V. Each N&V level, in turn, has its own associated calibration table or tables to determine a firing fraction. In one embodiment, the eco mode input has its associated set of calibration tables. As previously mentioned, the calibration tables may be preloaded, where each calibration table may be implemented as a set of n-dimensional (n-D) tables.

The allowed limit is the smaller of that dictated by noise (N) and that dictated by vibration (V). The noise and vibration limits are relaxed according to the N&V input and then the more restrictive limit (the smaller one) is chosen for operating the engine. Put another way in situations where noise (N) is relaxed more than vibration (V), or vice versa, the more restrictive firing fraction of the two results should be selected as the engine operating condition.

The acoustic masking levels can be determined in a variety of different ways. Acoustic masking levels can be detected by using a microphone in the vehicle cabin to measure interior noise levels. Additional information on contributors to cabin noise can be obtained through monitoring the audio signals going to the speaker system of the vehicle. Additionally, information on fans from cabin environmental controls (e.g., heating, cooling, fresh air, and window defrosting) may be used as an additional factor in determining an acoustic masking signal. Another technique is to calculate the frequencies and relative amplitudes of engine-induced noises relative to noise in the cabin. If the acoustic masking levels are high enough, the engine may be made to operate in a certain firing fraction conditions that would otherwise be perceived as poor for sound quality in the absence of acoustic masking.

Figure 16:
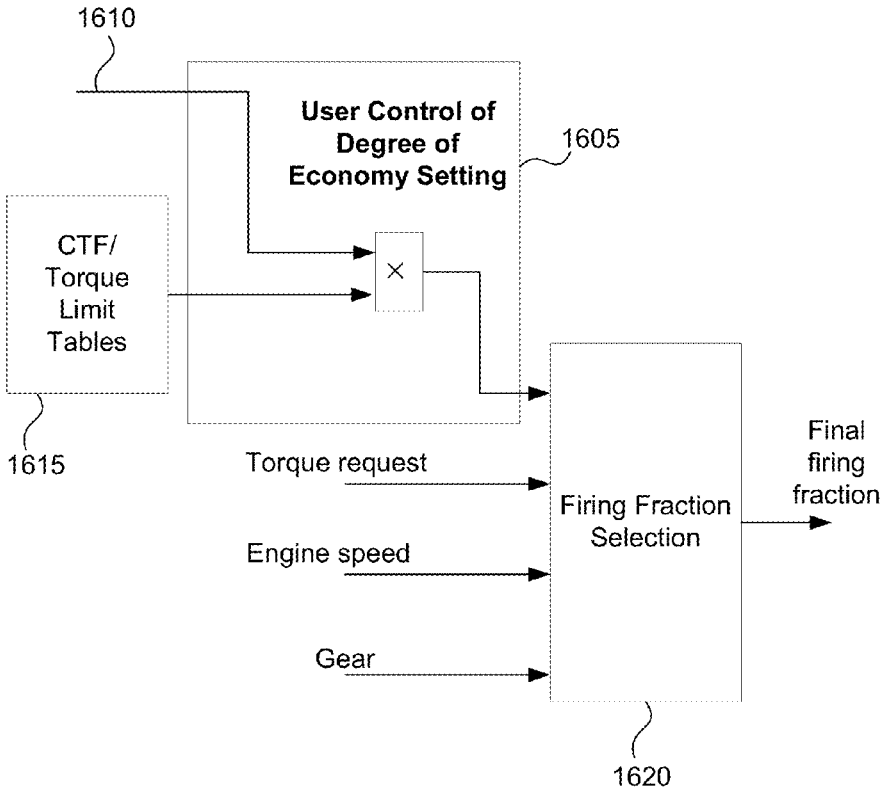
FIG. 16 illustrates an apparatus to vary limit table used to select a firing fraction based on a user-selection of a variable economy setting according to a particular embodiment of the present invention.

In one embodiment, the economy mode may be implemented as a simple on/off switch. However, more generally a user may select an economy mode with a range of economy levels, such as through a sequence of discrete CTF tables or by a variable correction factor to CTF tables. FIG. 16 illustrates an embodiment in which a user can select 1605 a variable economy mode input via a continuous slider or knob 1610. With a continuous input, the operator can decide how much vibration they are comfortable with. In one embodiment, the operator input signal is scaled and then multiplied with the pre-calibrated CTF/Torque limit tables 1615 to provide the selected level of NVH acceptability that the operator desires, which is then used by firing fraction selection module 1620. Alternatively, a range of economy levels (e.g. 2 or more economy modes) may be supported and the user selection is then used to determine a set of CTF tables based on the selected user economy setting.

Dynamic Skip Fire with Adjustments for Ambient Temperature

As previously discussed, undesirable NVH generated by the engine is transmitted to occupants in a vehicle cabin through a variety of paths. Additionally, the noise and vibration can also excite vehicle resonances, which are coupled into the cabin. One aspect of vehicle operation is that there is a temperature dependence to the frequency response of various components that transmit NVH into the vehicle cabin. These include the power train mounts, but may also include other components.

Temperature affects the structural isolation between the vehicle cabin, the engine, and other components of the power train. A typical automotive power train is affixed to the vehicle chassis using a mounting system including a plurality of mounts. For example, many mounting systems utilize three or four mounts to dampen noise and vibration from the engine and other components of the power train. These mounts typically utilize some kind of rubber (natural or synthetic) or other elastic material to provide isolation (dampening) of vibration and structure-borne noise. The mounts thus aid to isolate the engine by dampening engine excitations according to a frequency response of the mounts that is temperature dependent. The stiffness and damping characteristics of the mount material is carefully considered in designing a mounting system for good isolation characteristics during engine operation. However, the stiffness and damping characteristics of the isolation material is significantly influenced by temperature. The mounts of the mounting system are typically designed to provide the best isolation over a range of average temperatures. However, in many locations with cold winters the initial ambient temperature may be below the range of temperatures that the mounts provide the best isolation.

The mounts have a stiffness that is a function of temperature. The isolation provided by the mounts for a given frequency varies depends on the temperature of the mount material, which in turn depends on the ambient temperature as well as the extent to which heat generated by the power train has warmed the mounts after some initial startup time.

For good isolation, the engine's excitation frequencies (firing frequencies) are designed to be higher than the natural frequencies of the power train for some range of common ambient temperatures. At higher temperatures, when mounts become softer, the natural frequencies are lowered. This allows the engine to fire at lower frequencies without increasing noise and vibration levels. Conversely, at lower temperature, when the mounts are stiffer, the natural frequencies are higher.

The mounts will gradually warm up during operation of the engine as the engine heats up and warms the mounts. The rate at which the mounts warm up will depend on many factors. However, during winter driving it can take a significant amount of time for the power train and the mounts to warm up. For example, in cold winter conditions in can take 20 minutes or more for an engine and nearby regions to warm up to a steady state temperature corresponding to the temperature range in which the mounting system provides the best isolation with respect to the engine's excitation frequencies.

In one embodiment, the temperature of the mounting system is monitored by the operational skip fire profile module 136 and this information is used to determine adjustments to the firing fraction to maintain NVH within acceptable limits. In warm ambient conditions (e.g., summer temperatures), the mounts provide better isolation at a given firing fraction, which may provide options to operate a lower firing fraction, thus achieving better fuel efficiency. On the other hand, in extremely cold conditions, the mounts harden and provide a lower amount of isolation at a given firing fraction. In this case, a higher firing fraction may be chosen to maintain NVH within an acceptable level to provide a smooth and comfortable ride even in cold conditions. Moreover, as an engine runs the mounting system will gradually warm up from some initial starting ambient temperature. By monitoring the temperature of the system mounts, a selection can be made by the engine controller of a firing fraction that is adapted, over time as the engine is run, to provide the best fuel efficiency consistent with a smooth and comfortable ride.

In the case of driving in extremely cold conditions, this permits a mode of operation in which firing fraction is adapted as the mounting system gradually warms up during operation of the engine and provides progressively better isolation. In particular, certain firing fractions that would generate a noticeably rougher ride in cold conditions for some drivers can be avoided at startup while still permitting the firing fraction to be adjusted to improve fuel economy as the mounting system warms up. In other situations, monitoring of the temperature of the mounting system may permit increased options to select firing fractions that provide greater potential fuel savings than if the temperature dependence of the isolation of the mounts was not taken into account.

In one embodiment, the temperature response of the mounting system is used by the skip fire profile module 136 to determine adjustments to the selection of the firing fraction to maintain the NVH within an acceptable limit. The frequency response and vibration isolation characteristics of the engine mounts and their temperature dependency can be obtained from material suppliers or through testing. Knowing the operating temperature and the mount stiffness and damping variation with respect to temperature, a new CTF limit (or other torque metric, such as brake torque limit or net torque limit) is estimated that provides substantially the same level of noise and vibration as an original base calibration at a base temperature. This, in turn, changes the firing decision of the controller, providing optimal fuel efficiency taking into account the temperature dependence of the isolation provided by the mounts.

More generally, this approach can be extended to include any other temperature dependencies that determine how engine excitations are coupled into the vehicle cabin. Thus, more generally the temperature dependence of all components affecting the isolation or coupling of engine and power train excitations to the vehicle cabin may be taken into account by the operational skip fire profile module 136. Thermal sensors may be used to directly obtain data on temperature at different points in a vehicle. Temperatures may also be inferred from available temperatures in the engine. Thermal modeling may also be used to aid in estimating temperatures based on one or more temperature readings and a thermal model of the engine as a heat source warming up nearby components of the vehicle.

Figure 17:
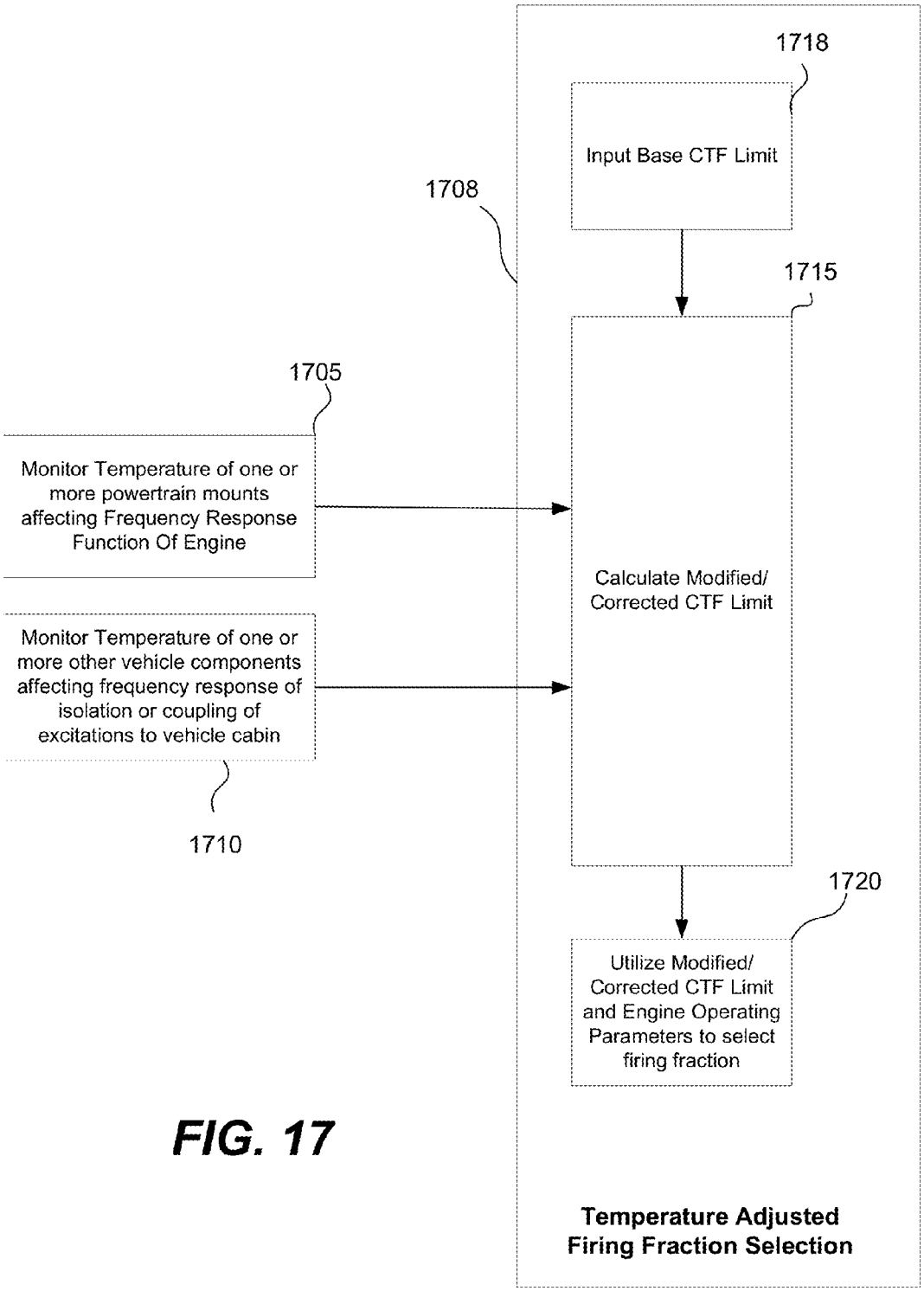
FIG. 17 illustrates a method of selecting a firing fraction in which at least one monitored temperature is used to optimize the selection according to a particular embodiment of the present invention.

Referring to FIG. 17, in one embodiment a method for the operational skip fire profile module 136 of engine controller 130 to select a firing fraction includes monitoring a temperature of one or more of the mounts 1705. In one embodiment a single mount temperature is used, which may be a representative temperature, an average temperature, or temperature indicative of the temperature response of the set of mounts. However, more generally the temperature of two or more of the mounts could be utilized. Moreover, in some embodiments, two or more different types of temperature measurement of the mounts may be utilized such a direct measurement of mount temperature based on a thermal sensor and an indirect measurement, such as a measurement based on one or more temperatures of the engine.

The temperature of the mount(s) may be measured using a sensor on the mount or in close proximity to the mount. However, more generally, the mount temperature may be indirectly determined from other measurements, such as an ambient temperature sensor, engine coolant temperature sensor, engine oil temperature sensor, and intake air temperature sensor. Additionally the mount temperature may be calculated based, in part, on a thermal model based on engine runtime and engine operating parameters. Additionally, monitoring 1710 may be performed of any other temperatures of the vehicle that affects NVH, including the temperature of any other components that has a temperature dependence in the manner in which they either isolate or couple engine excitations to the vehicle cabin.

The firing fraction is then selected 1708 based on engine operating parameters and monitored input temperature(s). In one embodiment the monitored temperature(s) are used to determine 1715 an adjustment to the CTF limits with respect to base CTF limits 1718. In one embodiment, the adjustment may be based on an engine model and/or empirical data implemented as a formula, lookup table(s) or model to map monitored input (temperatures) to adjustments of the CTF limits used to determine a firing fraction. In one embodiment, the adjustment is a correction to the base CTF limits 1718, such as a correction factor. The temperature adjusted CTF limits are then used to select a firing fraction 1720. In an alternate embodiment, the monitored temperature(s) are used to select from CTF tables pre-loaded for various monitored temperature conditions.

In an engine equipped with dynamic skip fire, performing a temperature based adjustment of base calibration CTF limit permits the firing fraction to be optimized based on mount temperature as an additional factor. The frequency with which adjustments are made based on temperature may be based on factors such as how long the car has been operated after an initial start, the initial monitored temperature(s), the temperature history, or other parameters. In principle, the temperature could be used in each firing fraction selection decision.

Figure 18:
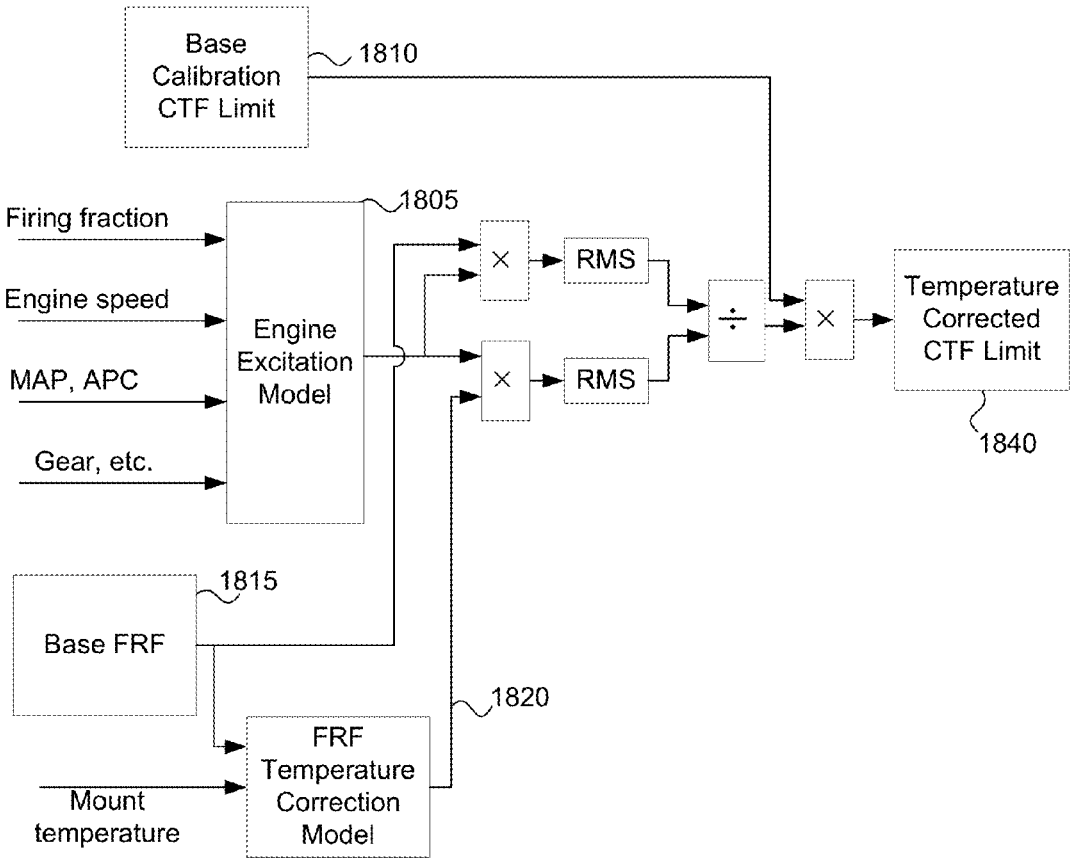
FIG. 18 illustrates a method of generating a temperature correction to a CTF limit used to select a firing fraction according to a particular embodiment of the present invention.

Referring to FIG. 18, in one embodiment, a method of performing a temperature adjustment to CTF limit is based on determining a frequency response function temperature correction. An engine excitation model 1805 is used to determine engine excitation (E) using engine operating parameters such as the firing fraction and other drive train operating parameters available, such as engine speed, MAP/APC/Torque, the gear or other parameters. The NVH will depend on the engine excitation and the frequency response of the mounts (which dampen vibration to provide partial isolation) at a given temperature.

In one embodiment, the mounts are modeled as having a Frequency Response Function (FRF) that varies with temperature. In one embodiment the FRF of the mounts is modeled as having a Base FRF 1815 (at a nominal temperature) and a temperature corrected FRF 1820 is generated based on the monitored mount temperature(s). The base FRF 1815 and temperature corrected FRF 1820 are then used to determine adjustments to the base calibrated CTF limit 1810.

A vibration level can be defined as the product of engine excitation, E, and the FRF of the mounts at a given temperature. Thus, a base vibration at some nominal base temperature, b, is $V_b$=$FRF_b$*E (where "*" is the multiplication sign). The vibration at a monitored temperature, t, is $V_t$=$FRF_t$*E. The change in vibration with temperature, in turn, can be used to calculate an adjustment to the CTF limits.

In one embodiment, a temperature corrected CTF limit (CTFL) 1840 is calculated by multiplying a base calibration CTF limit 1810 by the ratio of $V_b/V_t$ as set forth in equation 4, below. That is, if the CTF limit is known at some base temperature, then a corrected CTF limit may be calculated based on the base FRF and the temperature corrected FRF.

$$V_b = FRF_b * E \quad \text{(equation 2)}$$

$$V_t = FRF_t * E \quad \text{(equation 3)}$$

$$\frac{CTFL_t}{CTFL_b} = \frac{V_b}{V_t} \quad \text{(equation 4)}$$

In the embodiment of FIG. 18, the algorithm to implement equation 3 may be implemented using a sequence of multiply and divide operations to determine the correction. Statistical techniques may be employed to improve the calculations, such as determining a root mean square (RMS) value of the parameter used in equation 3. For example, the root mean square (RMS) of the base vibration level and the temperature corrected vibration level may be calculated. More generally, other statistical functions besides RMS could be used. A division is then performed in the divide block to calculate $V_b/V_t$, which is then multiplied by the base calibration CTF limit to arrive at the temperature corrected CTF limit. The corrected CTF limit is then used to select the firing fraction.

Figure 19:
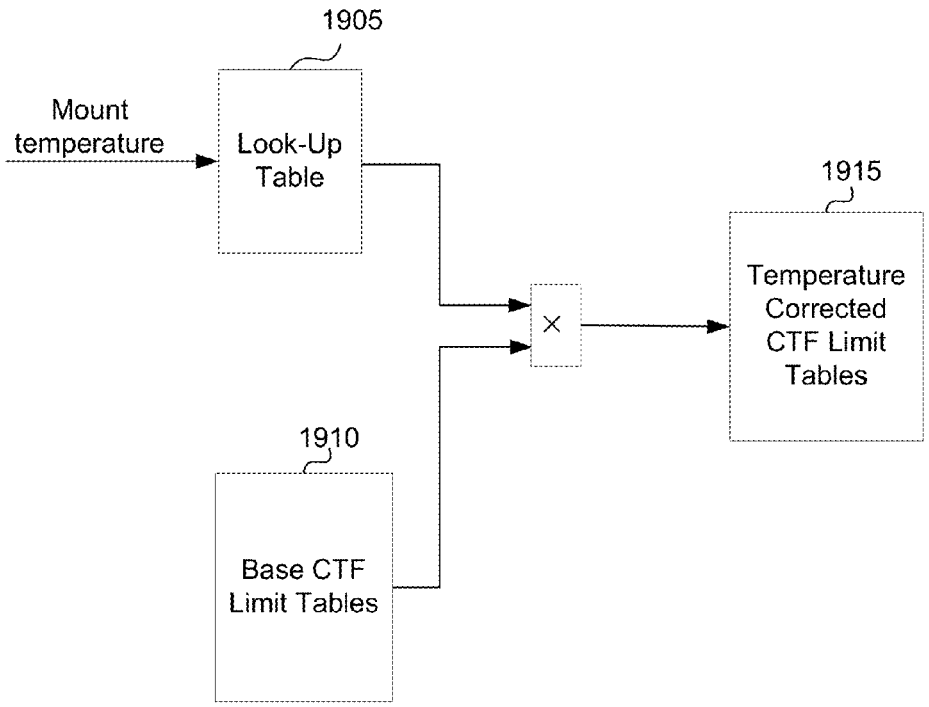
FIG. 19 illustrates a method of using a lookup table to determine a correction to a CTF limit table based on a mount temperature according to a particular embodiment of the present invention.

Referring to FIG. 19, in one embodiment one or more lookup tables 1905 are used to determine a correction to base CTF limit tables 1910. For example, the mount temperature(s) may be used to determine a correction factor from one or more lookup tables. The correction factor may be a multiplier or may be based on some other mathematical computation. The correction factor is used to correct the base CTF limit tables to obtain temperature corrected CTF limit tables 1915. In one embodiment, a calibration step is performed to characterize the system at various temperatures in order to define the lookup table. However, the table based factor is an approximation of the actual system response. For example one limitation is that the factor treats all vibration frequencies equally, which is an approximation of the actual system response. Thus, this approach, while requiring less computation, is also potentially less accurate than utilizing a full engine excitation model.

Figure 20:
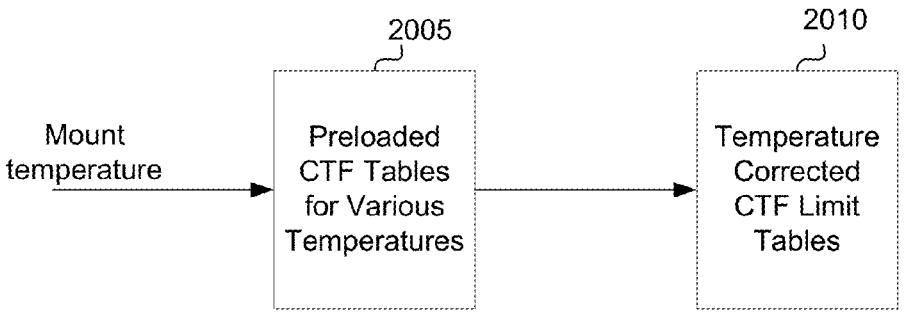
FIG. 20 illustrate a method of selecting a CTF limit table based on mount temperature according to a particular embodiment of the present invention.

Referring to FIG. 20, in one embodiment a set of pre-loaded CTF tables 2005 are provided for different temperature. The mount temperature(s) are then used to selected temperature corrected CTF limit tables 2010.

The appropriate table(s) is picked depending on the mount temperature at any given time. When the actual temperature falls between two pre-loaded temperature points, one approach is to pick the nearest table corresponding to the current temperature; pick the more conservative of the two nearest tables; or perform an interpolation between two different temperature tables to obtain the CTF limits for the current operating point.

More generally, a set of CTF limit tables could be provided for various temperatures and engine conditions. That is, additional aspects of engine operation could be accounted for in a set of CTF limit tables for various temperatures and other operating conditions to more closely approximate a full excitation model.

It will be understood that additional temperature effects may also be accounted for. For example, the clearances and mechanical fits in an automobile can vary with thermal expansion or contraction thus affecting the structural path of the noise and vibration. Additionally, a variation in temperature leads to different combustion characteristics that can change the frequency content of the engine excitation thus leading to different NVH. For example, a change in temperature might require adjustments in cam retard and spark advance angles that affect NVH. Also, the isolation characteristics of a torque converter or a manual transmission clutch may be different at cold temperatures.

Figure 21:
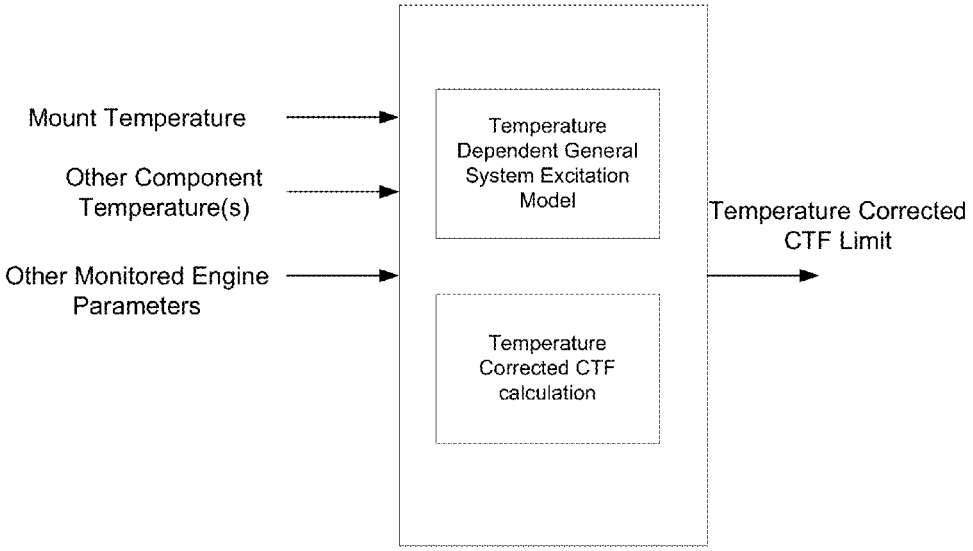
FIG. 21 illustrates determining a CTF limited based on a temperature-dependent general system excitation model.

Referring to FIG. 21, in one embodiment a general system excitation model is utilized that accounts for the temperature response of the mounts, other clearances and mechanical fits, any other temperature effects of the engine caused by temperature. Thus, an embodiment of the invention considers the vehicle system as a whole responding to the temperature variations and is not limited only to the temperature response of the engine mounts. Moreover, the general system excitation module may also be approximated via a set of tables in which a set of input temperatures is used to select an appropriate set of CTF limit tables (or other tables) to determine a firing fraction.

Although only a few embodiments of the invention have been described in detail, it should be appreciated that the invention may be implemented in many other forms without departing from the spirit or scope of the invention. There are several references to the term, firing fraction. It should be appreciated that a firing fraction may be conveyed or represented in a wide variety of ways. For example, the firing fraction may take the form of a firing pattern, sequence or any other firing characteristic that involves or inherently conveys the aforementioned percentage of firings. There are also several references to the term, "cylinder." It should be understood that the term cylinder should be understood as broadly encompassing any suitable type of working chamber. There are also several references to the terms, "CTF" and "CTF limit". It should be understood that the CTF can be conveyed as a brake torque, net torque, brake mean effective pressure (BMEP), net mean effective pressure (NMEP), engine torque fraction (ETF), or some other similar term indicative of a cylinder load. Therefore, the present embodiments should be considered illustrative and not restrictive and the invention is not to be limited to the details given herein.

What is claimed is:

1. A skip fire engine controller comprising:

a skip fire profile module arranged to determine an operational firing fraction and associated cylinder load for delivering a desired engine output, wherein the operational firing fraction is selected at least in part based on at least one temperature affecting a coupling of noise and vibration to a vehicle cabin at the selected operational firing fraction; and a firing controller arranged to direct firings in a skip fire manner that delivers the selected operational firing fraction.

2. A skip fire engine controller of claim 1, wherein:

the skip fire profile module is arranged to determine an operational firing fraction and associated cylinder load for delivering a desired engine output, wherein the skip fire profile module is arranged to select the operational firing fraction from a set of available firing fractions, wherein the set of available firing fractions varies as a function of cylinder load such that more firing fractions are available at lower cylinder loads than at higher cylinder load and the firing fraction is selected at least in part based on the at least one temperature affecting noise and vibration coupled to the vehicle cabin at the selected operational firing fraction.

3. The skip fire engine controller of claim 1, wherein the at least one temperature comprises a temperature of a power train mount system used to isolate engine excitations from the vehicle cabin.

4. The skip fire engine controller of claim 1, wherein the skip fire profile module is configured to adjust the operational firing fraction based on a temperature dependence of a stiffness of the set of power train mounts used to isolate engine excitations from the vehicle cabin.

5. The skip fire engine controller of claim 1, wherein the skip fire profile module is configured to adjust the operational firing fraction based on a temperature dependence of a frequency response function of an isolation system used to isolate engine excitations from the vehicle cabin.

6. The skip fire engine controller of claim 5, wherein the skip fire profile module is configured to adjust the operational firing fraction in response to a change in the temperature of the isolation system.

7. The skip fire engine controller of claim 1, wherein the at least one temperature is monitored based on at least one of a thermal sensor input, an engine temperature, and a thermal model.

8. The skip fire engine controller of claim 1, wherein the skip fire profile module is configured to monitor at least one additional temperature related to noise and vibration generated by the engine and utilize the at least one additional temperature to select the firing fraction.

9. The skip fire engine controller of claim 1, wherein the at least one temperature comprises a temperature of a portion of a fit or clearance of a component of a powertrain.

10. The skip fire engine controller of claim 1, wherein the selection of the operational firing fraction is based on at least one table indicative of allowable firing fractions for a set of engine operating parameters and a temperature adjustment of the at least one table is performed.

11. The skip fire engine controller of claim 10, wherein a correction factor to the at least one table is selected based on the at least one temperature.

12. The skip fire engine controller of claim 1, wherein the selection of the operational firing fraction is based on a set of tables for different temperature ranges and a selection is made of at least one table based on the at least one temperature.

13. The skip fire engine controller of claim 12, wherein the selection of the operational firing fraction involves selecting a lookup table, from a plurality of lookup tables, based on the at least one temperature.

14. The skip fire engine controller of claim 1, wherein the skip fire controller is configured to determine a correction to the firing fraction based on a system excitation model of a coupling of engine excitations to the vehicle cabin as a function of the at least one temperature.

15. The skip fire controller of claim 1, wherein the at least one temperature comprises a temperature of an isolation system used to isolate engine excitations from the vehicle cabin and skip fire profile module is configured to monitor the at least one temperature at least once subsequent to engine startup and adjust the selection of the firing fraction to maintain Noise, Vibration, and Harshness below a limit value.

16. The skip fire controller of claim 1, wherein a user may disable selection of the operational firing fraction and associated cylinder load based on the at least one temperature.

17. A skip fire engine controller comprising:

at least one lookup table embodied in a computer readable media, the at least one lookup table including table entries that indicate different maximum allowable cylinder loads at different vehicle operating parameters and provide adjustments based on at least one temperature associated with a temperature response of isolation of engine excitation from a vehicle cabin;

a skip fire profile module arranged to determine an operational firing fraction suitable for delivering a requested engine output, wherein the skip fire profile module utilizes the at least one lookup table to determine the operational firing fraction at the at least one monitored temperature; and a firing controller arranged to direct firings in a skip fire manner that delivers the operational firing fraction.

18. The skip fire engine controller as recited in claim 17, wherein the at least one monitored temperature comprises a temperature of an isolation mount system.

19. The skip fire engine controller as recited in claim 17, wherein the at least one monitored temperature comprises an engine or powertrain component.

20. A skip fire engine controller as recited in claim 17 wherein:

the firing fraction determination is based at least in part on a base firing fraction;

the skip fire engine controller further comprises a base firing fraction calculator that indicates a base firing fraction that is substantially optimally fuel efficient for a given engine speed and engine output.

21. A method of selecting an operational skip fire firing profile suitable for use in operating an internal combustion engine in a skip fire manner to produce a desired engine output, the method comprising:

determining a desired engine output;

monitoring at least one temperature affecting coupling of noise and vibration from the engine to a vehicle cabin; and selecting a firing fraction based at least in part on the coupling of noise and vibration to the vehicle cabin at the monitored at least one temperature.

22. The method of claim 21, further comprising:

selecting a plurality of candidate firing fractions from an allowed list of firing fractions;

calculating a candidate cylinder load for each of the plurality of candidate firing fractions such that the combination of the candidate cylinder load and each associated candidate firing fraction substantially yields the desired engine output, each such combination being a candidate skip fire firing profile;

selecting one of the candidate skip fire firing profiles as the operational skip fire firing profile; and operating the internal combustion engine based at least in part on the operational skip fire firing profile.

23. A method as recited in claim 21 further comprising:

determining which of the candidate skip fire firing profiles is most fuel efficient in delivering the engine output wherein the selection of the operational skip fire firing profile is based on the fuel efficiency determination.

24. A method as recited in claim 21 wherein:

the plurality of candidate firing fractions includes a first and a second candidate firing fraction;

calculating a first candidate cylinder load such that a combination of the first candidate firing fraction and the first candidate cylinder load delivers the desired engine output and forms a first candidate skip fire firing profile; and determining whether the first candidate skip fire firing profile is allowed wherein the allowance of the first candidate skip fire firing profile depends in part on whether the first candidate cylinder load exceeds a threshold wherein the threshold varies as a function of engine speed and transmission gear.

25. The method of claim 24, wherein the at least one temperature comprises a temperature of a mounting system associated with isolating engine excitations from the vehicle cabin.

26. The method of claim 25, wherein the mounting system has a temperature-dependent isolation response.

27. The method of claim 21, wherein the firing fraction is adapted at least once in response to detecting a change in the at least one temperature during operation of the engine.

28. The method of claim 21, wherein the mounting system has a frequency response function that varies with temperature and the firing fraction is adapted at least in part based on the excitation frequencies of the engine and the natural frequencies of the mounting system.

* * * * *